US006181083B1

(12) United States Patent
Moisin

(10) Patent No.: US 6,181,083 B1
(45) Date of Patent: Jan. 30, 2001

(54) BALLAST CIRCUIT WITH CONTROLLED STRIKE/RESTART

(75) Inventor: Mihail S. Moisin, Brookline, MA (US)

(73) Assignee: Electro-Mag, International, Inc., Scituate, MA (US)

( * ) Notice: Under 35 U.S.C. 154(b), the term of this patent shall be extended for 0 days.

(21) Appl. No.: 09/173,852

(22) Filed: Oct. 16, 1998

(51) Int. Cl.[7] ..... G05F 1/00
(52) U.S. Cl. ..... 315/291; 315/224; 315/308
(58) Field of Search ..... 315/307, 308, 315/244, 224, 225, 209 R, 291, 247

(56) References Cited

U.S. PATENT DOCUMENTS

| | | | |
|---|---|---|---|
| 3,808,481 | 4/1974 | Rippel | 318/139 |
| 4,115,729 | 9/1978 | Young et al. | 322/86 |
| 4,164,785 | 8/1979 | Young et al. | 363/50 |
| 4,270,164 | 5/1981 | Wyman et al. | 363/56 |
| 4,415,839 | 11/1983 | Lesea | 315/308 |
| 4,423,363 | 12/1983 | Clark et al. | 318/375 |
| 4,480,298 | 10/1984 | Fry | 363/28 |
| 4,489,373 | 12/1984 | du Parc | 363/56 |
| 4,507,698 | 3/1985 | Nilssen et al. | 361/42 |
| 4,525,648 | 6/1985 | De Bijl et al. | 315/224 |
| 4,572,988 | 2/1986 | Handler et al. | 315/209 R |
| 4,608,958 | 9/1986 | Sakakibara et al. | 123/605 |
| 4,618,810 | 10/1986 | Hagerman et al. | 318/803 |
| 4,624,334 | 11/1986 | Kelledes et al. | 180/79.1 |
| 4,675,576 | 6/1987 | Nilssen | 315/242 |
| 4,682,083 | 7/1987 | Alley | 315/307 |
| 4,684,851 | 8/1987 | Van Meurs | 315/224 |
| 4,712,045 | 12/1987 | Van Meurs | 315/224 |
| 4,783,728 | 11/1988 | Hoffman | 363/37 |
| 4,818,917 | 4/1989 | Vest | 315/171 |
| 4,864,486 | 9/1989 | Spreen | 363/126 |
| 4,866,586 | 9/1989 | Suko | 363/5 |
| 4,870,327 | 9/1989 | Jorgensen | 315/307 |

(List continued on next page.)

FOREIGN PATENT DOCUMENTS

| | | | |
|---|---|---|---|
| 4010435 | 10/1991 | (DE) . | |
| 4032664 | 4/1992 | (DE) . | |
| 0460641 | 12/1991 | (EP) . | |
| 0522266 | 1/1993 | (EP) . | |
| 2204455 | 11/1988 | (GB) . | |
| 63-002464 | 11/1988 | (JP) | H02H/9/08 |
| 9422209 | 9/1994 | (WO) . | |
| 9535646 | 12/1995 | (WO) . | |

OTHER PUBLICATIONS

Kazimierczuk, Marian et al. "Resonant Power Converters", (1995), A Wiley–Interscience Publication, pp. 332–333.
"Simple Dimming Circuit for Fluorescent Lamp", IBM Technical Disclosure Bulletin, vol. 34, No. 4A, Sep. 1, 1991, pp. 109–111, XP000210848.

*Primary Examiner*—Don Wong
*Assistant Examiner*—Wilson Lee
(74) *Attorney, Agent, or Firm*—Nutter, McClennen & Fish, LLP

(57) ABSTRACT

A ballast circuit for energizing a lamp includes an inverter circuit with a start up circuit which provides a repeating start up sequence until a lamp lights. The start up circuit includes a start up switching element coupled across a start up capacitor which initiates operation of the inverter. A rapid start capacitor is charged as the inverter applies a signal to the lamp and the voltage on the rapid start capacitor determines the conduction state of the start up switching element. The inverter applies an increasing strike voltage to the lamp until the lamp lights or until the lamp voltage becomes greater than a predetermined level. After the restart capacitor discharges, the start up capacitor charges to re-initiate operation of the inverter. The ballast thereby applies a strike voltage to the lamp having a relatively small duty cycle for reduced stress on the circuit components.

20 Claims, 17 Drawing Sheets

U.S. PATENT DOCUMENTS

| | | | |
|---|---|---|---|
| 4,899,382 | 2/1990 | Gartner | 379/413 |
| 4,952,853 | 8/1990 | Archer | 318/254 |
| 4,991,051 | 2/1991 | Hung | 361/57 |
| 5,003,231 | 3/1991 | Perper | 315/291 |
| 5,004,955 | 4/1991 | Nilssen | 315/119 |
| 5,014,305 | 5/1991 | Moisin | 379/402 |
| 5,027,032 | 6/1991 | Nilssen | 315/103 |
| 5,052,039 | 9/1991 | Moisin | 379/402 |
| 5,063,339 | 11/1991 | Orii et al. | 318/696 |
| 5,081,401 | 1/1992 | Moisin | 315/324 |
| 5,124,619 | 6/1992 | Moisin et al. | 315/219 |
| 5,138,233 | 8/1992 | Moisin et al. | 315/187 |
| 5,138,234 | 8/1992 | Moisin | 315/209 R |
| 5,138,236 | 8/1992 | Bobel et al. | 315/209 R |
| 5,144,195 | 9/1992 | Konopka et al. | 315/94 |
| 5,148,087 | 9/1992 | Moisin et al. | 315/291 |
| 5,173,643 | 12/1992 | Sullivan et al. | 315/276 |
| 5,177,408 | 1/1993 | Marques | 315/291 |
| 5,191,263 | 3/1993 | Konopka | 315/209 R |
| 5,216,332 | 6/1993 | Nilssen | 315/224 |
| 5,220,247 | 6/1993 | Moisin | 315/209 R |
| 5,223,767 | 6/1993 | Kulka | 315/209 R |
| 5,256,939 | 10/1993 | Nilssen | 315/244 |
| 5,291,382 | 3/1994 | Cohen | 363/16 |
| 5,309,066 | 5/1994 | Ditlevsen | 315/205 |
| 5,313,143 | 5/1994 | Vila-Masot et al. | 315/209 R |
| 5,315,533 | 5/1994 | Stich et al. | 364/480 |
| 5,332,951 | 7/1994 | Turner et al. | 315/209 R |
| 5,334,912 | 8/1994 | Counts | 315/119 |
| 5,390,231 | 2/1995 | Hung et al. | 379/2 |
| 5,399,943 | 3/1995 | Chandrasekaran | 315/219 |
| 5,416,388 | 5/1995 | Shackle | 315/219 |
| 5,432,817 | 7/1995 | Hormel et al. | 375/257 |
| 5,434,477 | 7/1995 | Crouse et al. | 315/209 R |
| 5,434,480 | 7/1995 | Bobel | 315/224 |
| 5,444,333 | 8/1995 | Lau | 315/94 |
| 5,446,365 | 8/1995 | Nomura et al. | 320/14 |
| 5,481,160 | 1/1996 | Nilssen | 315/209 R |
| 5,493,180 | 2/1996 | Bezdon et al. | 315/91 |
| 5,504,398 | 4/1996 | Rothenbuhler | 315/209 R |
| 5,515,433 | 5/1996 | Chen | 379/398 |
| 5,563,479 | 10/1996 | Suzuki | 318/139 |
| 5,574,335 | 11/1996 | Sun | 315/119 |
| 5,579,197 | 11/1996 | Mengelt et al. | 361/93 |
| 5,583,402 | 12/1996 | Moisin et al. | 315/307 |
| 5,608,295 | 3/1997 | Moisin | 315/247 |
| 5,608,595 | 3/1997 | Gourab et al. | 361/79 |
| 5,638,266 | 6/1997 | Horie et al. | 363/132 |
| 5,684,683 | 11/1997 | Divan et al. | 33/65 |
| 5,686,799 * | 11/1997 | Moisin et al. | 315/307 |
| 5,691,606 | 11/1997 | Moisin et al. | 315/307 |
| 5,783,911 * | 7/1998 | Rudolph | 315/225 |
| 5,798,615 * | 8/1998 | Gasparini et al. | 315/244 |
| 5,798,617 | 8/1998 | Moisin | 315/247 |
| 5,821,699 | 10/1998 | Moisin | 315/291 |
| 5,825,136 * | 10/1998 | Rudolph | 315/244 |
| 5,831,396 | 11/1998 | Rudolph | 315/307 |
| 5,866,993 | 2/1999 | Moisin | 315/307 |
| 5,925,986 | 7/1999 | Moisin | 315/247 |

* cited by examiner

BALLAST CIRCUIT WITH CONTROLLED STRIKE/RESTART

CROSS REFERENCE TO RELATED APPLICATION

Not Applicable.

STATEMENT REGARDING FEDERALLY SPONSORED RESEARCH

Not Applicable.

FIELD OF THE INVENTION

The present invention relates to circuits for energizing one or more loads and more particularly to a circuit that regulates the amount of energy flowing to at least one load.

BACKGROUND OF THE INVENTION

As is known in the art, there are many of types of artificial light sources such as incandescent, fluorescent, and high-intensity discharge (HID) light sources. Fluorescent and HID light sources or lamps are generally driven with a ballast which includes various inductive, capacitive and resistive elements. The ballast circuit provides a predetermined level of current to the lamp which causes the lamp to emit light. To initiate current flow through the lamp, the ballast circuit may provide relatively high voltage levels, e.g., a strike voltage, that differ from operational levels.

One type of ballast circuit is a magnetic or inductive ballast. One problem associated with magnetic ballasts is the relatively low operational frequency which results in a relatively inefficient lighting system. Magnetic ballasts also incur substantial heat losses thereby further reducing the lighting efficiency. Another drawback associated with magnetic ballasts is the relatively large size of the inductive elements.

To overcome the low efficiency associated with magnetic ballasts, various attempts have been made to replace magnetic ballasts with electronic ballasts. One type of electronic ballast includes inductive and capacitive elements coupled to a lamp. The ballast provides voltage and current signals having a frequency corresponding to a resonant frequency of the ballast-lamp circuit. As known to one of ordinary skill in the art, the various resistive, inductive and capacitive circuit elements determine the resonant frequency of the circuit. Such circuits generally have a half bridge or full bridge configuration that includes switching elements for controlling operation of the circuit.

Conventional ballasts generally provide particular voltage and current levels adapted for a single lamp size. Thus, a ballast is only useful for one particular lamp. As known to one skilled in the art, the diameter of the lamp determines the level of current that flows through the lamp. That is, lamps of eight feet, four feet, two feet and one foot all pass about the same amount of current, provided that the lamps have the same diameter. The voltage drop across the lamp, however, varies in accordance with the length of the lamp. The longer the lamp, the greater the voltage drop across the lamp. It would be desirable to provide a ballast that can energize any lamp in a family of lamps where each lamp has the same diameter and a different length.

Another drawback to some known ballast circuits is associated with initiating, or attempting to initiate, current flow through the lamps. One type of ballast initially operates in a so-called rapid start mode to establish current flow through the lamp and thereby cause the lamp to emit light.

In rapid start mode, the ballast heats the lamp filaments with a predetermined current flow through the filaments prior to providing a strike voltage to the lamp. Thereafter, the ballast provides operational levels of voltage and current to the lamp as it emits visible light. However, in the case there a lamp does not light, such as a lamp that is only marginally operational, excessive energy levels can be generated by the circuit. High voltages and currents can stress the circuit components and thereby reduce the useful life of the ballast. It would, therefore, be desirable to provide a ballast that detects and eliminates excessive signal levels that can occur when a lamp fails to start. It would also be desirable to provide a ballast circuit that, when attempting to light the lamp, applies a strike voltage to the lamp at predetermined intervals to reduce stress on the ballast circuit components.

SUMMARY OF THE INVENTION

The present invention provides a circuit for regulating the amount of energy flowing to one or more loads and detecting excessive energy levels. Although primarily shown and described as a ballast circuit that controls the energy flow to at least one lamp, it is understood that the circuit is applicable to other circuits and loads as well, such as power supplies and electrical motors.

In one embodiment, a ballast circuit includes an inverter circuit for energizing at least one lamp. The inverter circuit includes first and second switching elements coupled to a resonant inductive element. A first control circuit controls the conduction state of the first switching element and a second control circuit controls the conduction state of the second switching element. In one particular embodiment, the inverter circuit is a resonant inverter with the first and second switching elements coupled in half bridge configuration. During resonant operation of the circuit, the first switching element is conductive while current to the load flows in one direction and the second switching element is conductive as the load current flows in the opposite direction.

In an exemplary embodiment, the duty cycle of the second switching element is selectively reduced to achieve desired power levels at the lamp. However, it is understood that the duty cycle of the first switching element can be altered in addition to or instead of the duty cycle of the second switching element.

To control the duty cycle of the second switching element, the second control circuit includes a third switching element coupled to the second switching element and a third control circuit for controlling the conductive state of the third switching element. The third switching element is effective to transition the second switching element to a non-conductive state when the third switching element transitions to a conductive state. In one embodiment, an inductive bias element, which is inductively coupled with the resonant inductive element, is coupled to the second and third switching elements for biasing the switching elements to a conductive state. In particular, when the voltage polarity at the bias element switches to a first polarity corresponding to current flow through the second switching element, the bias element biases the second and third switching elements to a conductive state. However, a delay circuit coupled to the third switching element delays the transition of the third switching element to the conductive state. Thus, the second switching element is conductive until the delay time expires and the third switching element becomes conductive thereby causing the second switching element to transition to the non-conductive state.

In one feature of the invention, excessive energy levels generated by the resonant circuit are detected and eliminated. Excessive voltages can occur when a lamp fails to light and the power to the lamp continues to increase without being consumed by the lamp. In one embodiment, the circuit includes a first threshold circuit coupled to the third switching element for detecting a voltage at the bias element that is greater than a first predetermined threshold. When a voltage at the bias element exceeds the first predetermined threshold, the third switching element is biased to the conductive state which transitions the second switching element to the non-conductive state. When the second switching element is non-conductive, power to the load is reduced.

In one particular embodiment, the first threshold circuit includes a zener diode for providing the first predetermined threshold. In other embodiments, the circuit can include further threshold circuits coupled to further switching elements, such as a fourth switching element described below, for detecting further excess voltage conditions.

Another feature of the invention includes duty cycle modification of the second switching element to adjust the power supplied to the load. In an exemplary embodiment, the third control circuit further includes a fourth switching element coupled to the third switching element for altering the conduction state of the third switching element. The fourth switching element is coupled to the delay circuit for modifying the delay for the third switching element to transition to the conductive state.

In one embodiment, a maximum duty cycle for the fourth switching element corresponds to a maximum power at the load. More particularly, when the fourth switching element remains conductive, the delay of the delay circuit is maximized thereby allowing the second switching element to remain on for the longest time since the third switching element does not become conductive (and turn off the second switching element) until the maximum delay time has expired. Conversely, as the fourth switching element becomes non-conductive the delay is reduced and the duty cycle of the second switching element decreases to reduce the power at the load.

In another feature of the invention, a ballast circuit regulates the lamp current to a predetermined level regardless of the voltage drop across the lamp. Thus, the ballast circuit is adapted for energizing any lamp in a family of lamps wherein the lamps vary in length, which alters the voltage drop, but have the same diameter, which determines the operational current level. In one embodiment, the circuit includes a fifth switching element coupled to the fourth switching element in a feedback arrangement to regulate the load current. The circuit further includes a feedback resistor, through which current to the lamp flows, coupled to the fifth switching element. The feedback resistor is effective, in conjunction with the circuit switching elements, to regulate the lamp current to a predetermined level regardless of the voltage drop across the lamp.

In a further feature of the invention, the circuit includes a start-up circuit for providing a strike level voltage to the lamp at predetermined intervals thereby reducing the amount of power that is applied to a lamp that fails to start. In one embodiment, the start-up circuit repeats a start-up sequence associated with so-called rapid start mode of operation. In one particular embodiment, the start-up circuit includes a delay capacitor coupled to a rail of the inverter and a delay switching element coupled to a start-up capacitor which initially starts the circuit by biasing the second switching element to the conductive state. When the lamp fails to start after application of a strike level voltage, the circuit can detect an excess voltage condition and reduce power to the lamp, as described above. The charged delay capacitor biases the delay switching element to a conduction state that prevents the start-up capacitor from charging. After the delay capacitor discharges, the start-up capacitor then begins charging to repeat the rapid start sequence.

In another embodiment in accordance with the present invention, a ballast circuit includes a threshold detection circuit for detecting excessive energy levels. In one particular embodiment, the ballast circuit includes an inverter circuit having first and second switching elements for energizing a lamp. A first control circuit is coupled to the first switching element and a second control circuit is coupled to the second switching element for controlling the conduction states of the respective first and second switching elements. The threshold detection circuit is coupled to the second control circuit for altering the conduction state of the second switching element to eliminate an excessive power condition. The threshold detection circuit is coupled to the lamp and to a bridge capacitor which is also connected to the lamp. The threshold detection circuit includes a first feedback resistor coupled to the lamp and a second feedback resistor coupled to the bridge capacitor. The first and second feedback resistors are also coupled to a third switching element which biases the second switching element to a non-conductive state when an excessive energy level is detected.

In operation, the ballast circuit first attempts to initiate current flow through the lamp during rapid-start operation. The first and second switching elements are alternately conductive and a current flows through the lamp filaments to pre-heat the filament prior to applying a strike voltage to the lamp. This pre-heat current flows through the capacitor to the threshold detection circuit through the second feedback resistor. If the lamp fails to light, the current through the capacitor continues to increase until a voltage drop across the second feedback resistor is sufficient to bias the third switching element to a conductive state. This biases the second switching element to a non-conductive state thereby reducing the power. Similarly, during normal operation current flows through the lamp. If the lamp current increases to a level such that a voltage drop across the first feedback resistor transitions the third switching element to a conductive state, the second switching element transitions to a non-conductive state thereby reducing the power to the lamp.

In a further embodiment, a ballast circuit in accordance with the present invention has a full bridge topology. In one particular embodiment, the ballast circuit includes an inverter circuit having first and second switching elements, first and second bridge diodes and first and second resonant inductive elements coupled in a full bridge configuration. A first control circuit is coupled to the first switching element and a second control circuit is coupled to the second switching element for controlling the conduction states of the respective switching elements. The second control circuit includes a third switching element coupled to the second switching element for altering the conduction state of the second switching element. Coupled to the second and third switching elements is a bias element that is inductively coupled to at least one of the first and second inductive elements for biasing the first and second switching elements to a conduction state. More particularly, a predetermined time after the bias element biases the second switching element to a conductive state, the third switching element becomes conductive thereby transitioning the second switching element to the non-conductive state.

The ballast circuit further includes a feedback resistor coupled between the second and third switching elements. When the load current is greater than a predetermined threshold, the third switching element is biased to a conductive state thereby causing the second switching element to transition to a non-conductive state. In one embodiment, the ballast circuit also includes a voltage threshold circuit coupled between the bias element and the third switching element. When the voltage at the bias element is greater than a predetermined voltage, the third switching element becomes conductive and the second switching element non-conductive thereby reducing the load power.

BRIEF DESCRIPTION OF THE DRAWINGS

The invention will be more fully understood from the following detailed description taken in conjunction with the accompanying drawings, in which.

DETAILED DESCRIPTION OF THE INVENTION

The present invention provides a circuit that regulates the amount of energy that is transferred to one or more loads. In general, the power to the load is regulated by controlling the duty cycle of one or more switching elements that energize the load. Exemplary embodiments are shown and described in the form of ballast circuits for energizing one or more lamps that regulate the flow of current to a predetermined level, prevent excessive signal levels, and periodically repeat a lamp start-up sequence known as rapid start mode. By regulating the current level, the ballast circuit can energize lamps that differ in length but have about the same diameter. And by detecting excessive energy levels and controlling the start-up sequence, circuit stress can be reduced to extend the useful life of the ballast, particularly when lamps fail to light.

The ballast circuits are generally shown having circuitry for implementing a so-called rapid-start mode of operation. As known to one of ordinary skill in the art, during rapid start operation a current is passed through the lamp filaments for a period of time, e.g. 500 milliseconds, typically referred to as pre-heat, before applying a voltage level that is sufficient to strike the lamp.

It is understood that end-of-life, as used herein, refers to conditions or circuitry associated with a lamp that, at least initially, fails to light. Generally, as a lamp ages it becomes increasingly difficult to initiate current flow through the lamp. That is, the lamp becomes marginally operational and the likelihood of successfully initiating current flow through the lamp decreases. It is understood by one of ordinary skill in the art that a resonant ballast circuit can apply relatively high signal levels to the lamp which can severely stress the circuit components when the lamp fails to light.

Figure 1:
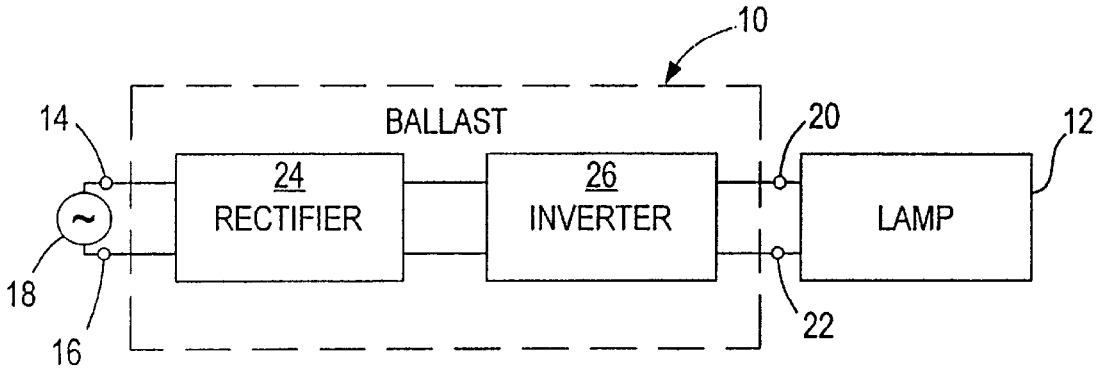
FIG. 1 is schematic diagram of a ballast circuit in accordance with the present invention including an inverter circuit.

FIG. 1 shows a ballast circuit 10 for controlling the flow of energy to a lamp 12 in accordance with the present invention. The ballast 10 includes first and second input terminals 14,16 coupled to an alternating current (AC) power source 18 and first and second output terminals 20,22 coupled to the lamp 12. The ballast 10 includes a rectifier circuit 24 for receiving the AC signal and providing a direct current (DC) signal to an inverter circuit 26 which energizes the lamp 12 with an AC signal.

Figure 2:
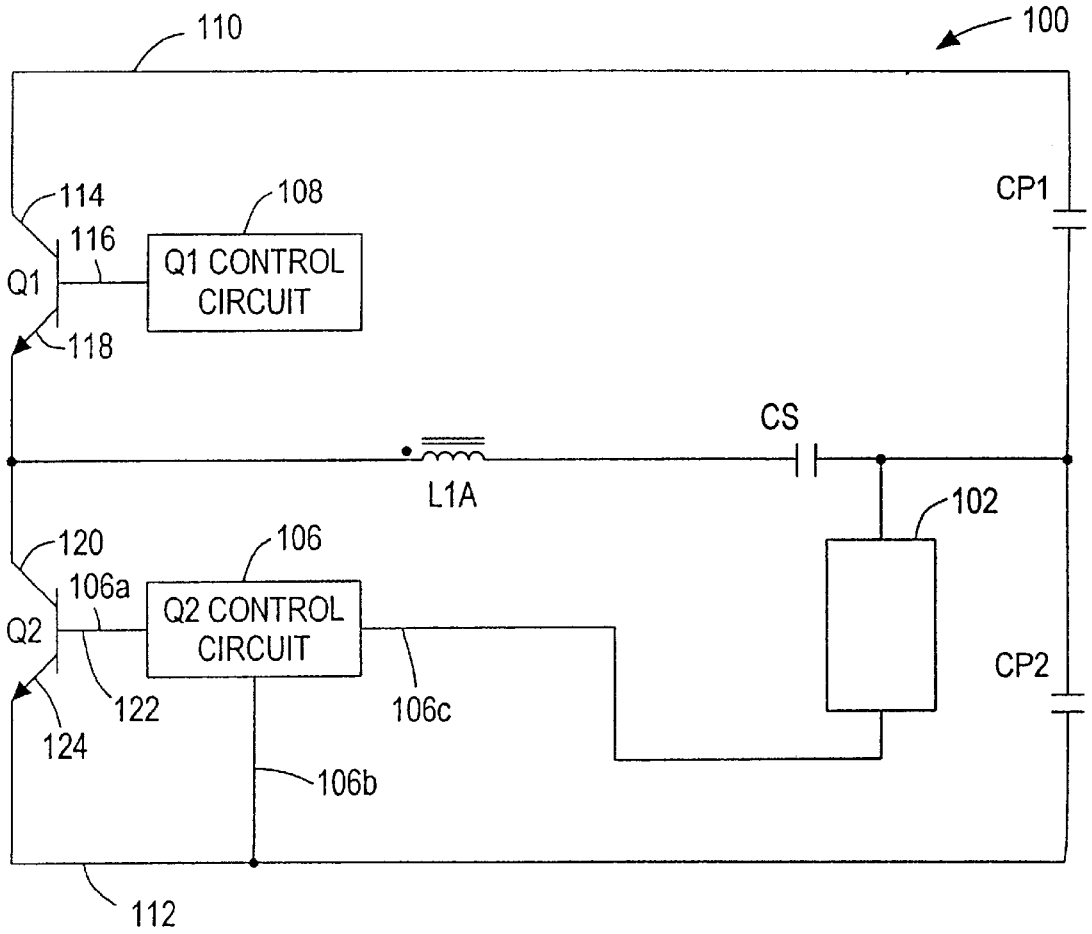
FIG. 2 is a schematic block diagram of the inverter circuit of FIG. 1.

Referring now to FIG. 2, a circuit 100, shown here as a resonant inverter circuit, such as the inverter circuit 26 of FIG. 1, includes first and second switching elements Q1,Q2 coupled in a half bridge configuration. The switching elements Q1,Q2 are shown as transistors, however, it is understood that other switching elements known to one of ordinary skill in the art can be used. It is further understood that the switching elements Q1,Q2, and the other circuit elements, can be coupled in configurations other than the half bridge arrangement of FIG. 1. For example, other embodiments include circuits having conventional full bridge arrangements with four switching elements and full bridge topologies, such as those disclosed in co-pending and commonly assigned U.S. patent application Ser. No. 08/948,690 filed Oct. 10, 1997, entitled CONVERTER/INVERTER FULL BRIDGE BALLAST CIRCUIT, incorporated herein by reference.

The inverter circuit 100 has a resonant inductive element L1A and a DC-blocking capacitor CS coupled in series. A load 102, such as a fluorescent lamp, is adapted for connection to the DC-blocking capacitor CS. The lamp 102 is also coupled to a point between first and second bridge capacitors CP1,CP2 which are coupled end to end across the positive and negative rails 110, 112 of the inverter. A first control circuit 108 is coupled to the first switching element Q1 and a second control circuit 106 is coupled to the second switching element Q2. The control circuits 106,108 control the conduction states of the respective first and second switching elements Q1,Q2.

The first switching element Q1 includes a first or collector terminal 114 coupled to the positive rail 110 of the inverter, a second or base terminal 116 coupled to the first control circuit 108 and a third or emitter terminal 118 coupled to the second switching element Q2 and the resonant inductive element L1A. The second switching element Q2 includes a first or collector terminal 120 coupled to the emitter terminal 118 of the first switching element Q1 and the resonant inductive element L1A. A second or base terminal 122 is coupled to the second control circuit 106 and a third or emitter terminal 124 is coupled to the negative rail 112 of the inverter.

The second control circuit 106 has a first terminal 106*a* coupled to the base terminal 122 of the second switching element Q2 and a second terminal 106*b* coupled to the negative rail 112. A third terminal 106*c* is coupled to the lamp 102 for detecting the energy level through the lamp. As described below and shown in the illustrative embodiment of FIG. 2, the duty cycle of the second switching element Q2 is selectively decreased by the second control circuit 106. However, it is understood that in other embodiments the duty cycle of the first switching element Q1 is altered instead of or in addition to the duty cycle of the second switching element Q2.

In general, the inverter circuit 100 circuit is adapted for operation at or near a resonant frequency that is a characteristic of the overall circuit. The impedance values of the circuit components, such as the resonant inductive element L1A, the bridge capacitors CP1,CP2 and the lamp 102 determine the resonant frequency of the circuit. When the inverter 100 is driven at the resonant frequency the first and second switching elements Q1,Q2 are alternately conductive as current to the lamp 102 periodically reverses directions. That is, for a first half of the resonant cycle the first switching element Q1 is ON (Q2 is OFF) and current flows through the resonant inductive element L1A to the lamp 102. During the second half of the resonant cycle, the second switching element Q2 is ON (Q1 is OFF) and current flows from the lamp 102 to the resonant inductive element L1A and through the second switching element Q2. It is understood that ON refers to a conductive state for a switching element and that OFF refers to a non-conductive state.

To maximize power to the lamp 102, a respective one of the first and second switching elements Q1,Q2 should be ON during each half cycle for as long as possible. However, there are circumstances during which it is desirable to limit the power to the lamp 102. As understood by one of ordinary skill in the art, due to the resonant nature of the circuit high signal levels can be generated by the circuit that may destroy the circuit elements if left unchecked. As described below, the circuit limits and/or regulates the load current by controlling the duty cycle of second switching element Q2.

Figure 3:
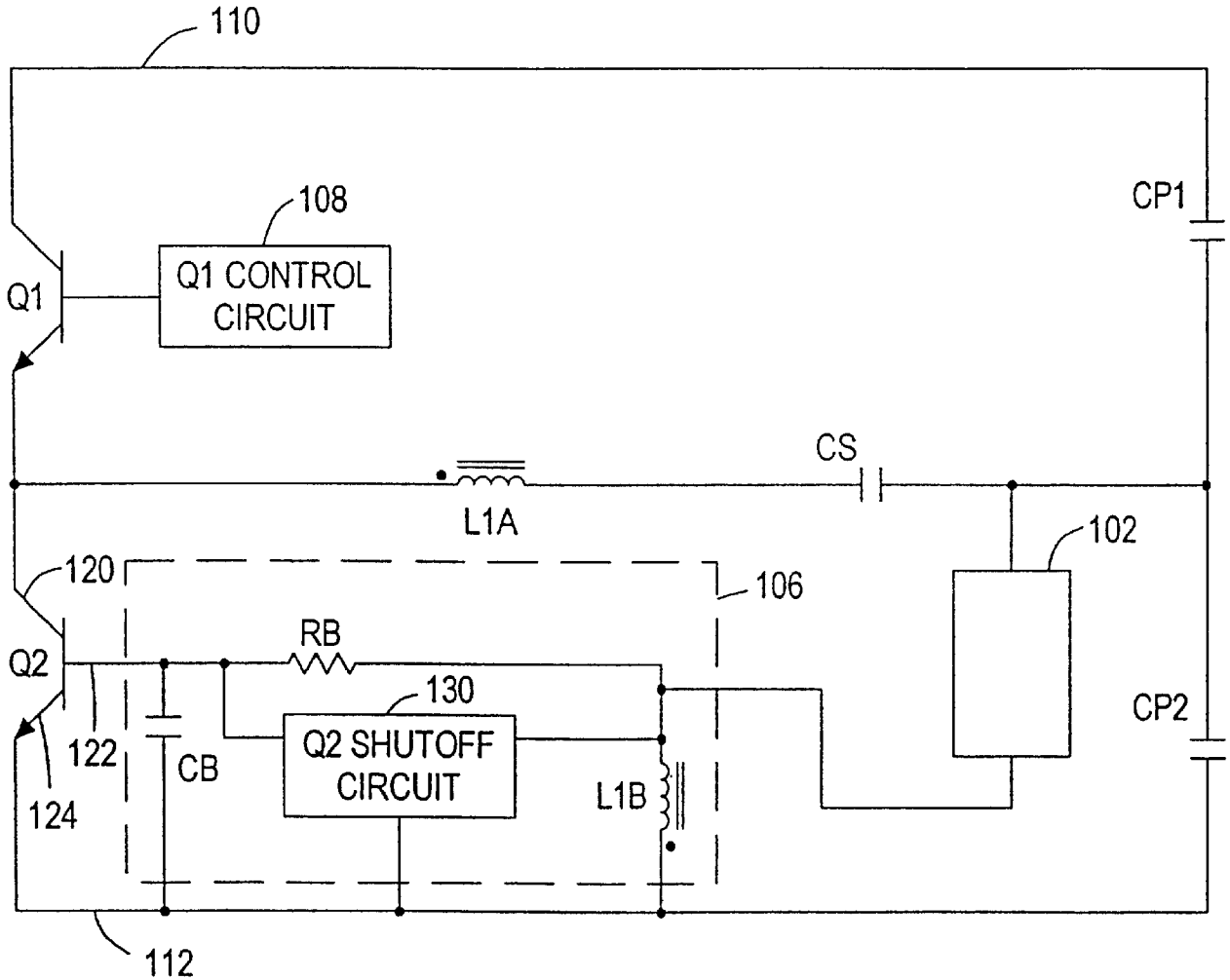
FIG. 3 is a circuit diagram that includes further details of the circuit of FIG. 2.

FIG. 3 shows an exemplary embodiment of the second control circuit 106 that includes circuit elements (RB,CB, L1B) for controlling the conduction state of the second switching element Q2 and a third or Q2 shutoff circuit 130 for turning the second switching element Q2 off upon detection of certain conditions, as described below.

The conduction state of the second switching element Q2 is controlled such that it is generally ON when current flows in a direction from the lamp 102 to the resonant inductive element L1A. The base terminal 122 of the second switching element Q2 is coupled to base resistor RB which is coupled to an inductive bias element L1B. The bias element L1B is inductively coupled to the resonant inductive element L1A. And a base capacitor CB extends from the base terminal 122 to the negative rail 112.

Figure 3A:
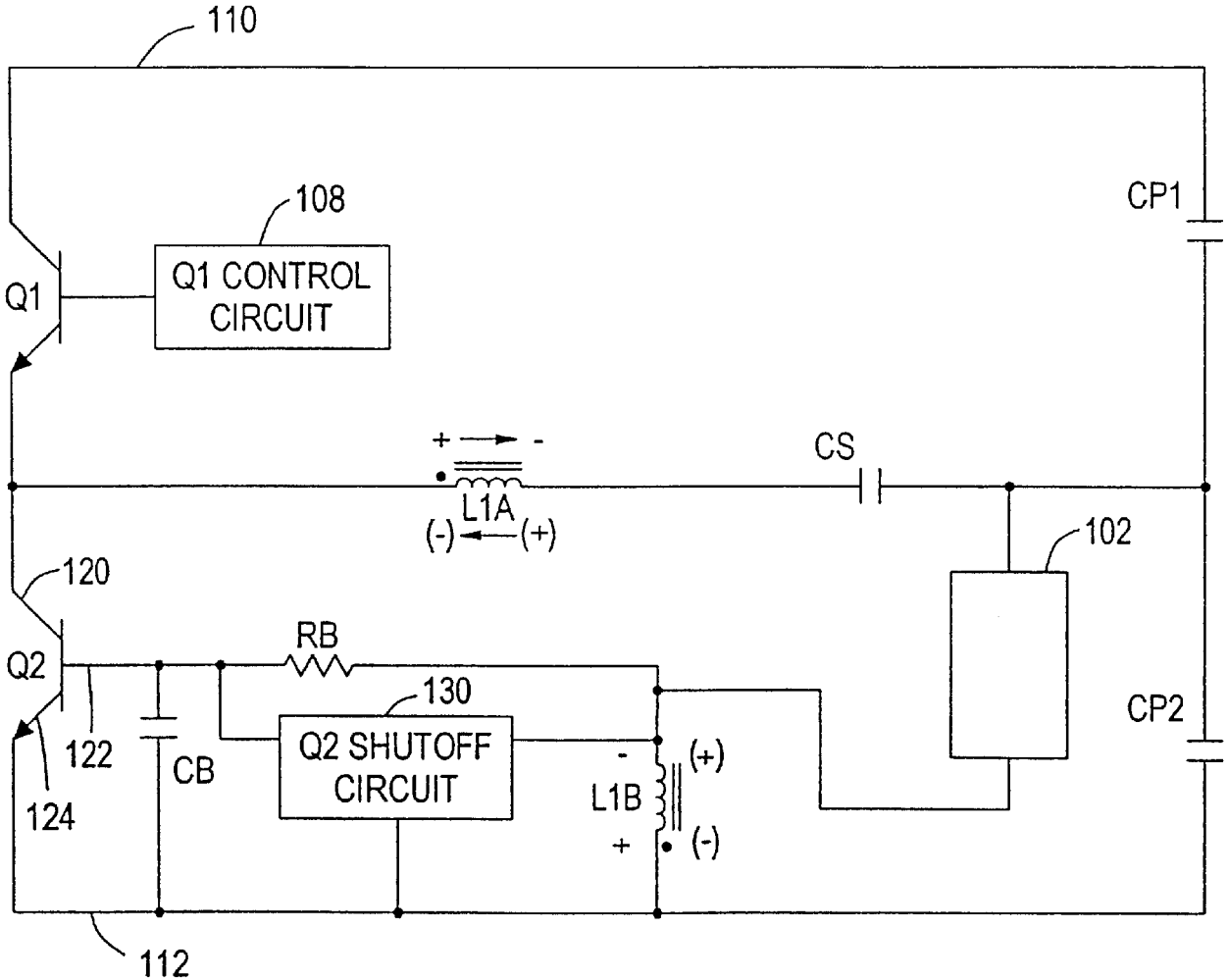
FIG. 3A is a circuit diagram that includes further details of the circuit of FIG. 3.

As shown in FIG. 3A, these circuit elements are effective to turn the second switching element Q2 ON as current flows in a direction from the lamp 102 to the resonant inductive element L1A. The resonant inductive element L1A has a polarity indicated by conventional dot notation. As understood to one of ordinary skill in the art, the dot indicates a rise in voltage from the unmarked end to the marked end. The bias element L1B, which is inductively coupled with the resonant inductive element L1A, has a polarity also indicated with conventional dot notation. The polarities of the respective voltages across the resonant inductive element L1A and the bias element L1B are indicated with a "+" for a positive voltage and a "−" for a negative voltage. In general, for current flowing in a direction from the resonant inductive element L1A to the lamp 102 (Q1 ON) the polarities are shown without parentheses and for current flowing in an opposite direction, from the lamp to the resonant inductive element L1A (Q2 ON), the polarities are shown within the parentheses.

As can be seen by examining the voltage at the bias element L1B, the second switching element Q2 is biased to the OFF state when current flows to the lamp 102 from the inductive element L1A. More particularly, a negative potential is applied to the base terminal 122 of the npn transistor Q2 to turn it OFF. And when the current reverses direction due to the resonant nature of the circuit, voltage polarities at the bias element L1B switch thereby biasing the transistor Q2 to the ON state by applying a positive potential to the base terminal 122. The RC network formed by the base resistor RB and the base capacitor CB provide a small delay to ensure that the first and second switching elements Q1,Q2 are not ON at the same time. This condition is commonly known as cross conduction and is undesirable as the positive and negative rails 110,112 are effectively shorted together through the switching elements Q1,Q2.

Figure 4:
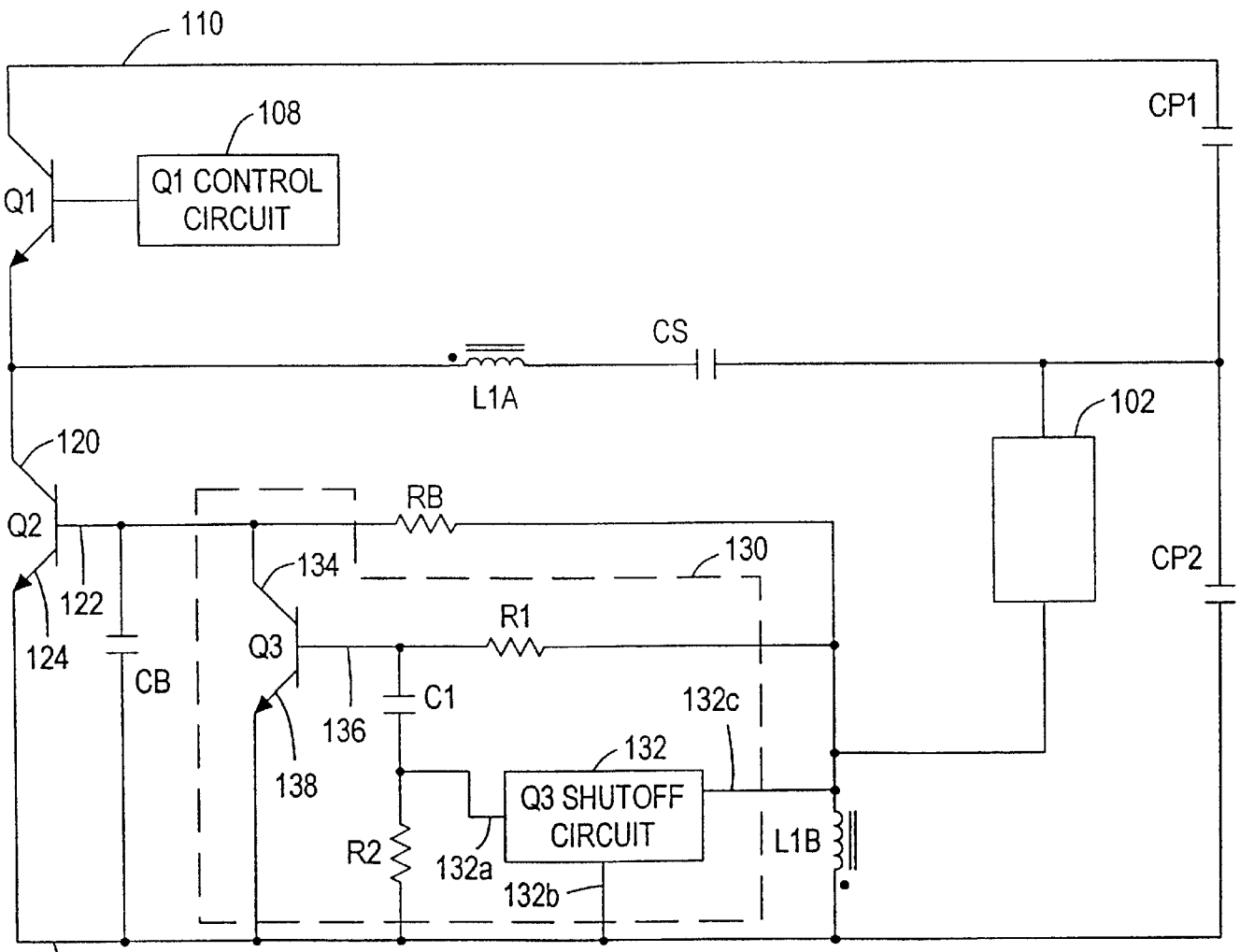
FIG. 4 is a circuit diagram that includes further details of the circuit of FIG. 3.

FIG. 4 shows the Q2 shutoff circuit 130 of FIG. 2 in further detail. The Q2 shutoff circuit 130 includes a third switching element Q3 and an RC network (R1,C1,R2) coupled to a Q3 shutoff circuit 132. The third switching element Q3 is shown as an npn transistor having a collector terminal 134 coupled to the base terminal 122 of the second switching element Q2, a base terminal 136 coupled to both a first resistor R1 and a first capacitor C1, and an emitter terminal 138 coupled to the negative rail 112 of the inverter. The first capacitor C1 and a second resistor R2 are coupled between the base terminal 136 of the third switching element Q3 and the negative rail 112. The Q3 shutoff circuit 132 has a first terminal 132*a* coupled to a point between the series-coupled first capacitor C1 and the second resistor R2. A second terminal 132*b* of the Q3 shutoff circuit is coupled to the negative rail 112 and a third terminal 132*c* is coupled to the unmarked end of the bias element L1B.

The RC network formed by R1, C1, and R2 is effective to turn the third switching element Q3 ON a preselected time after the bias element L1B applies a positive bias. The delay time is determined by the impedance values of the elements R1, C1 and R2 in the RC network. When the third switching element Q3 is ON, a relatively small positive voltage comparable to the base-emitter voltage drop of Q3, will be present on the first capacitor C1. However, when the third switching element Q3 is OFF, the first capacitor C1 will charge to a more significant voltage level, for example about minus five volts. When the bias element L1B first switches polarity so as to positively bias the base terminal 122, the second switching element Q2 turns ON. The bias element L1B also applies a bias to the base terminal 136 of the third switching element Q3. However, the third switching element Q3, will not turn ON until the negative charge on the first capacitive element C1 discharges. Thus, the second switching element Q2 turns ON and remains ON until the third switching element Q3 turns ON. The delay for the third switching element Q3 to turn ON determines the duty cycle of the second switching element Q2. It is understood that the turning ON of the second switching element Q2 is determined by the natural resonance of the circuit and that the turning OFF of this element is altered by Q3.

As the third switching element Q3 transitions to the ON state, the second switching element Q2 is turned off. As described below, the Q3 shutoff circuit 132 is effective to shorten the duty cycle of the second switching element Q2 or turn it off when excessive current levels are detected by turning Q3 ON.

Figure 5:
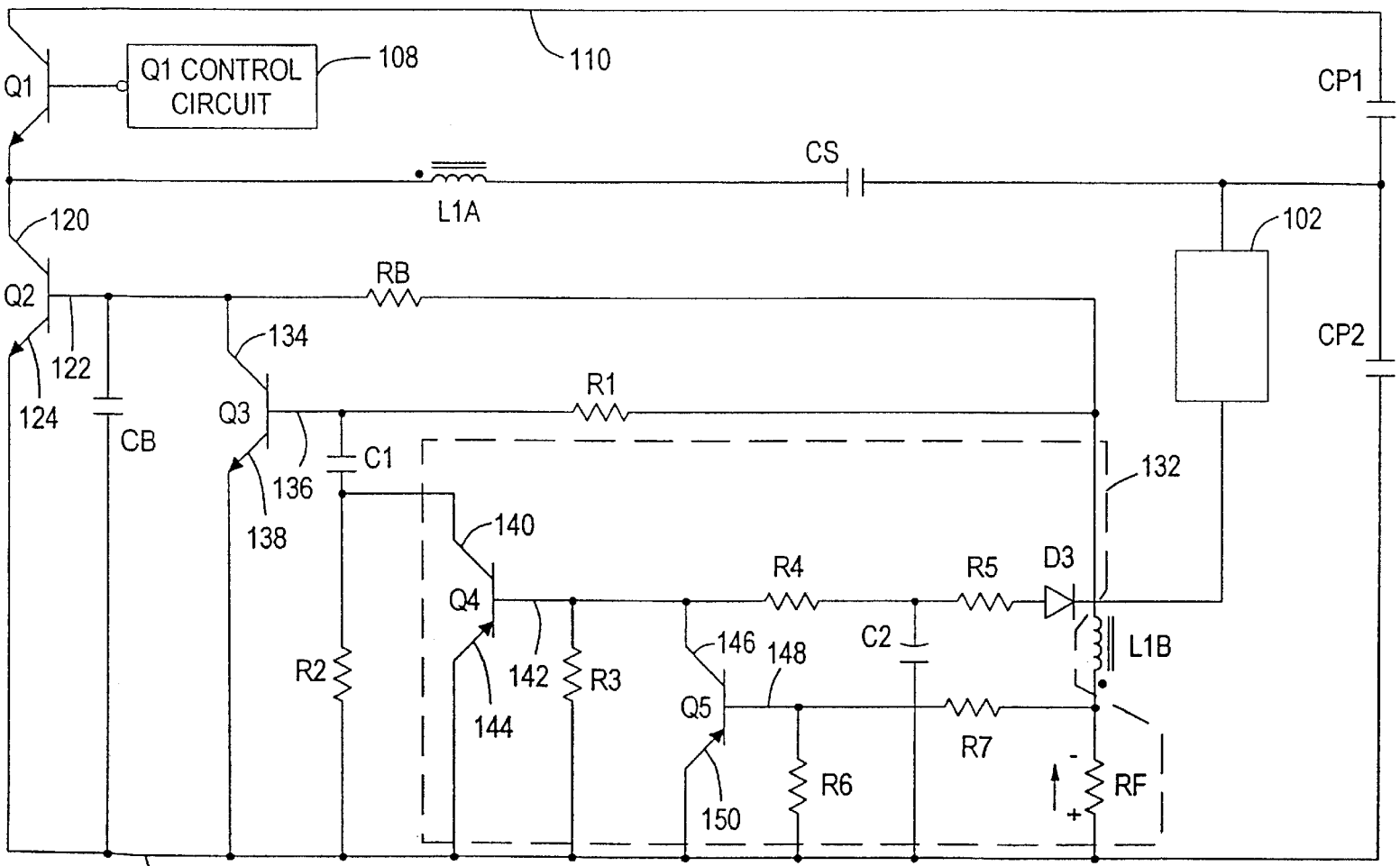
FIG. 5 is a circuit diagram of an exemplary embodiment of the circuit of FIG. 2.

FIG. 5 shows an exemplary embodiment of the Q3 shutoff circuit 132. The Q3 shutoff circuit 132 includes additional switching elements Q4,Q5, shown here as pnp transistors, that are effective to monitor the power to the load and selectively shorten the duty cycle of the second switching element Q2. The fourth switching element Q4 has a first or collector terminal 140 coupled to a point between the series-coupled first capacitor C1 and second resistor R2, a second or base terminal 142 coupled to the negative rail 112 via a third resistor R3, and a third or emitter terminal 144 coupled to the negative rail 112. A fourth resistor R4 is coupled between the base terminal 142 of the fourth switching element Q4 and a fifth resistor R5. A third diode D3 is coupled between the fifth resistor R5 and the unmarked end of the bias element L1B. A second or pre-heat capacitor C2 is coupled at one end to a point between the fourth and fifth resistors R4,R5 and at the other end to the negative rail 112.

The fifth switching element Q5 has a collector terminal 146 coupled to the base terminal 142 of the fourth switching element Q4, a base terminal 148 coupled to the negative rail 112 via a sixth resistor R6, and an emitter terminal 150 coupled to the negative rail. A feedback resistor RF is coupled between the negative rail 112 and the marked end of the bias element L1B with a seventh resistor R7 extending between the base terminal 148 of Q5 and the marked end of the bias element L1B.

The fourth switching element Q4 is effective to limit the energy flowing to the lamp 102 by adjusting the delay associated with the RC network formed by the first resistor R1, the first capacitor C1, and the second resistor R2. More particularly, when the fourth switching element Q4 is ON maximum power can be transferred to the lamp 102. And when the fourth switching element Q4 is OFF less power can be transferred to the lamp 102.

When the fourth switching element Q4 is ON, this transistor substantially removes the resistance of the second resistor R2 from the circuit. By effectively shorting the second resistor R2, the impedance of this resistor does not factor into the time delay associated with the RC network (R1, C1, R2). The first capacitor C1 therefore discharges relatively slowly such that the time required to positively bias (by the bias element L1B) the base terminal 136 of the third switching element Q3 is maximized. By maximizing the time to turn the third switching element Q3 ON, the time that the second switching element Q2 remains ON is also maximized thereby allowing the greatest amount of energy to flow to the lamp 102.

However, when the fourth switching element Q4 is OFF, the resistance of the second resistor R2 does factor into the time delay of the RC network (R1, C1, R2). Therefore, the time delay is reduced and the first capacitor C1 discharges relatively quickly. Since the first capacitor C1 discharges more quickly with the fourth switching element Q4 OFF, the third switching element Q3 turns ON more rapidly. Consequently, the second switching element Q2 turns OFF earlier and the energy transferred to the load 102 is reduced.

The power control feature provided by the fourth switching element Q4 operates in start up mode as well as normal operation. The lamp 102 begins to emit light after a sequence of steps commonly referred to as rapid start mode. As known to one of ordinary skill in the art, in rapid start mode a current is first passed through the lamp 102 filaments to pre-heat the filaments for a predetermined amount of time, such as about 500 milliseconds. After pre-heating the filaments, a strike voltage, e.g., 500 volts for a four foot lamp, is applied to the lamp to initiate current flow. Thereafter, an operational voltage, e.g., 140 volts, appears across the lamp as current flows through the lamp causing it to emit visible light.

To pre-heat the lamp filaments, relatively low power should be applied to the lamp 102. Initially, the second capacitor C2 is not charged and the fourth switching element Q4 is OFF (minimum power). This provides minimum power to the lamp 102 as the second capacitor C2 charges and the lamp filaments are pre-heated. It should be noted that the second capacitor C2 charges negatively. When the voltage level across the second capacitor C2 is sufficient to overcome the emitter-base junction voltage of the fourth switching element Q4, shown as a pnp transistor, this transistor turns ON (maximum power). The power to the lamp 102 therefore increases as the duty cycle of the second switching element Q2 increases such that a strike level voltage is generated and applied to the lamp 102. After striking the lamp 102 and initiating current flow, the circuit provides operational signal levels to the lamp as it emits light.

Another feature of the ballast circuit is regulation of the load current such that lamps of differing power requirements can be energized. Typically, a fluorescent lamp family includes a series of lamps that have a common diameter but vary in length. For example, the lamps can come in eight foot, four foot, three foot, and two foot lengths. These lamps all require about the same amount of current since the diameter generally determines the current level. However, the voltage drop across the lamp increases as the length increases. The voltage drop across an eight foot lamp can be about 280 volts, 140 volts for a four foot lamp, and about 70 volts for a two foot lamp. The circuit regulates the current to the lamp 102 to a predetermined level regardless of the particular voltage drop associated with the particular lamp placed in circuit, as described below.

Lamp current regulation is achieved with a feedback circuit that causes current to flow at a predetermined level regardless of the voltage drop across the lamp. As described above, when the second switching element Q2 is ON current flows from the negative rail 112 to the lamp 102 and through the resonant inductive element L1A. This current flow generates a voltage drop across the feedback resistor RF. When the voltage drop is sufficiently large, the fifth switching element Q5, shown here as a pnp transistor, turns ON. And when Q5 turns ON, Q4 turns OFF and the power to the lamp 102 is reduced, as described above. As the power is reduced, Q5 turns OFF, Q4 turns ON and the power to the load is increased. Due to this feedback arrangement, the current through the feedback resistor RF, and therefore the lamp 102, will settle to a predetermined level. In the exemplary embodiment shown, the emitter-base voltage drop across the pnp transistor Q5 is about 0.7 volts. Ignoring the voltage drop across the seventh resistor, the voltage drop across the sense resistor will also be about 0.7 volts. By selecting a certain value for the feedback resistor RF, e.g., one ohm, the lamp current can be regulated to a predetermined level, such as about 230 milliamps, without regard to the voltage drop across the lamp.

The feedback circuit described above provides real time power control. That is, the circuit is controlled without a delay of even one cycle. Thus, a transient signal, that may otherwise cause cross conduction or other undesirable circuit conditions, is detected and prevented from damaging the circuit. This is in contrast to some known circuits that rectify a signal which is coupled to an integrated circuit and circuits that examine signal amplitudes. Such circuits generally require one or more cycles to respond to a transient or other signal.

A further feature of the invention detects excessive signal levels when a lamp is marginally operational, e.g., it does not light after application of a strike voltage. Lamp end-of-life, as used herein, refers to a lamp that is barely functional such that it may not light upon initial application of a strike voltage. As a lamp ages, typically it becomes more difficult to cause a current to pass through the lamp and thereby emit light. Although the lamp may not light after applying a strike voltage only once, it may light after repeated striking or application of a steady state strike voltage. However, where a steady state strike voltage is applied to a lamp that does not light, the circuit can generate a relatively high level of power that is not consumed by the lamp, e.g., is wasted. This can have a negative impact on the overall circuit in the form of component stress and heat build up.

The ballast circuit of the present invention allows the power applied to the load to be reduced by shortening the duty cycle of or turning OFF the second switching element Q2 after detecting an excess voltage condition when trying to strike the lamp. The circuit also provides a repeating start-up sequence that applies a strike level voltage at preselected time intervals thereby reducing circuit stress and increasing circuit efficiency.

Figure 6:
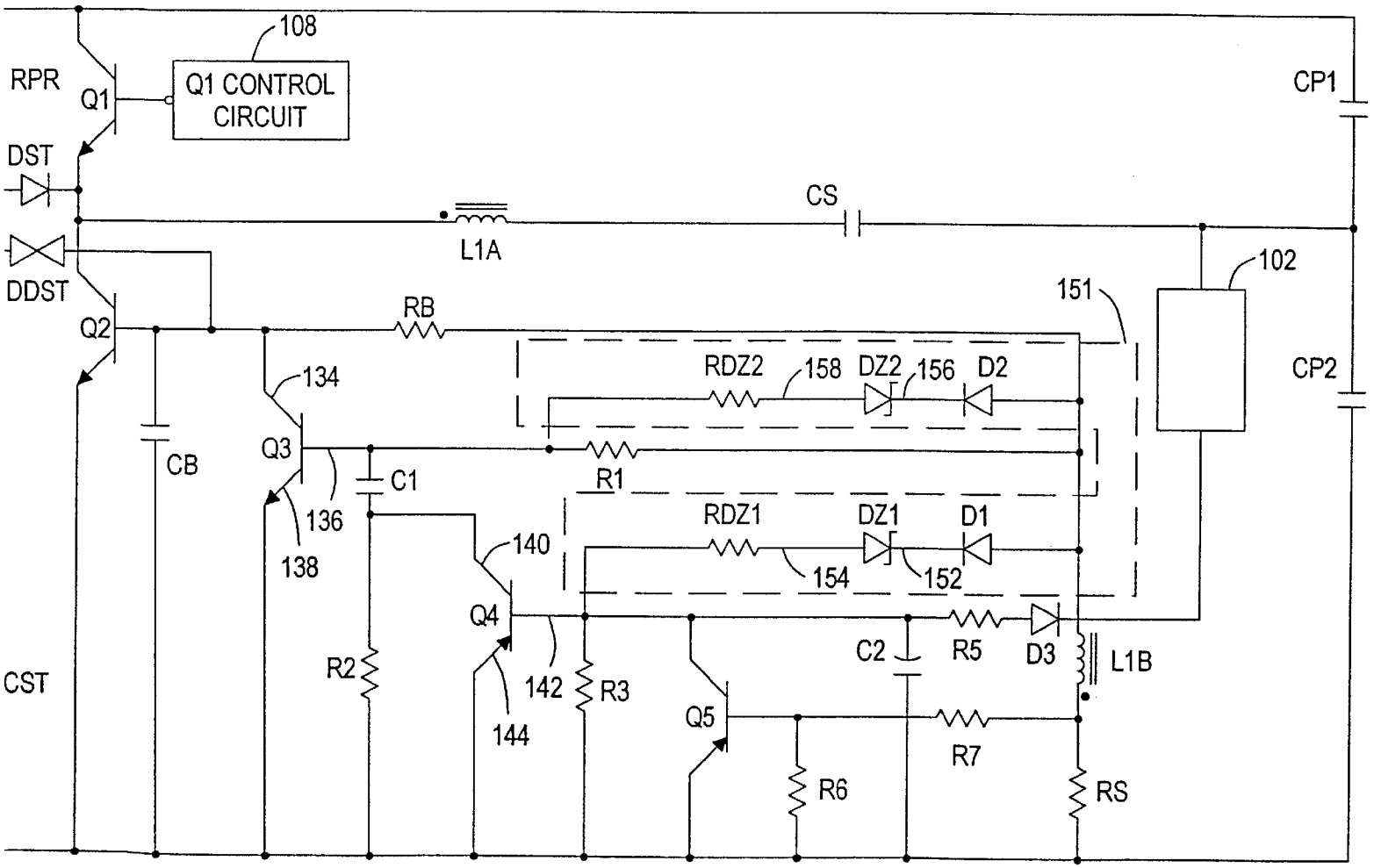
FIG. 6 is a circuit diagram showing further features of the circuit of FIG. 2.

In an exemplary embodiment shown in FIG. 6, an end-of-life 151 circuit includes a first zener diode DZ1 having a cathode 152 coupled to the unmarked end of the bias element L1B via a first diode D1 and an anode 154 coupled to the base terminal 142 of the fourth transistor Q4 via a resistor RDZ1. The end-of-life circuit can also include a second zener diode DZ2 having a cathode 156 coupled to the unmarked end of the bias element L1B via a second diode D2 and an anode 158 coupled to the base terminal 136 of the third transistor Q3 via a resistor RDZ2.

In operation, the circuit resonates thereby generating higher and higher voltages as the lamp 102 fails to strike, i.e., conduct current. When the voltage at the unmarked end of the bias element L1B becomes greater than a first predetermined threshold associated with the first zener diode DZ1, the fourth switching element Q4 is turned OFF. As described above, turning Q4 OFF reduces the energy transmitted to the lamp 102. Similarly, when the voltage at the unmarked end of the bias element L1B becomes greater than a second predetermined threshold determined by the second zener diode DZ2, the base terminal 136 of the third transistor Q3 is positively biased thereby turning it ON which turns the second switching element Q2 OFF so as to disable the inverter.

In another feature of the invention, a ballast circuit includes a start-up circuit that implements a repeating start-up sequence that periodically applies a strike voltage to a lamp. The start-up circuit applies a strike voltage to the lamp at predetermined intervals until the lamp lights. By limiting the amount of time that a strike level voltage is applied to a lamp that fails to light, circuit stress is greatly reduced.

Figure 7:
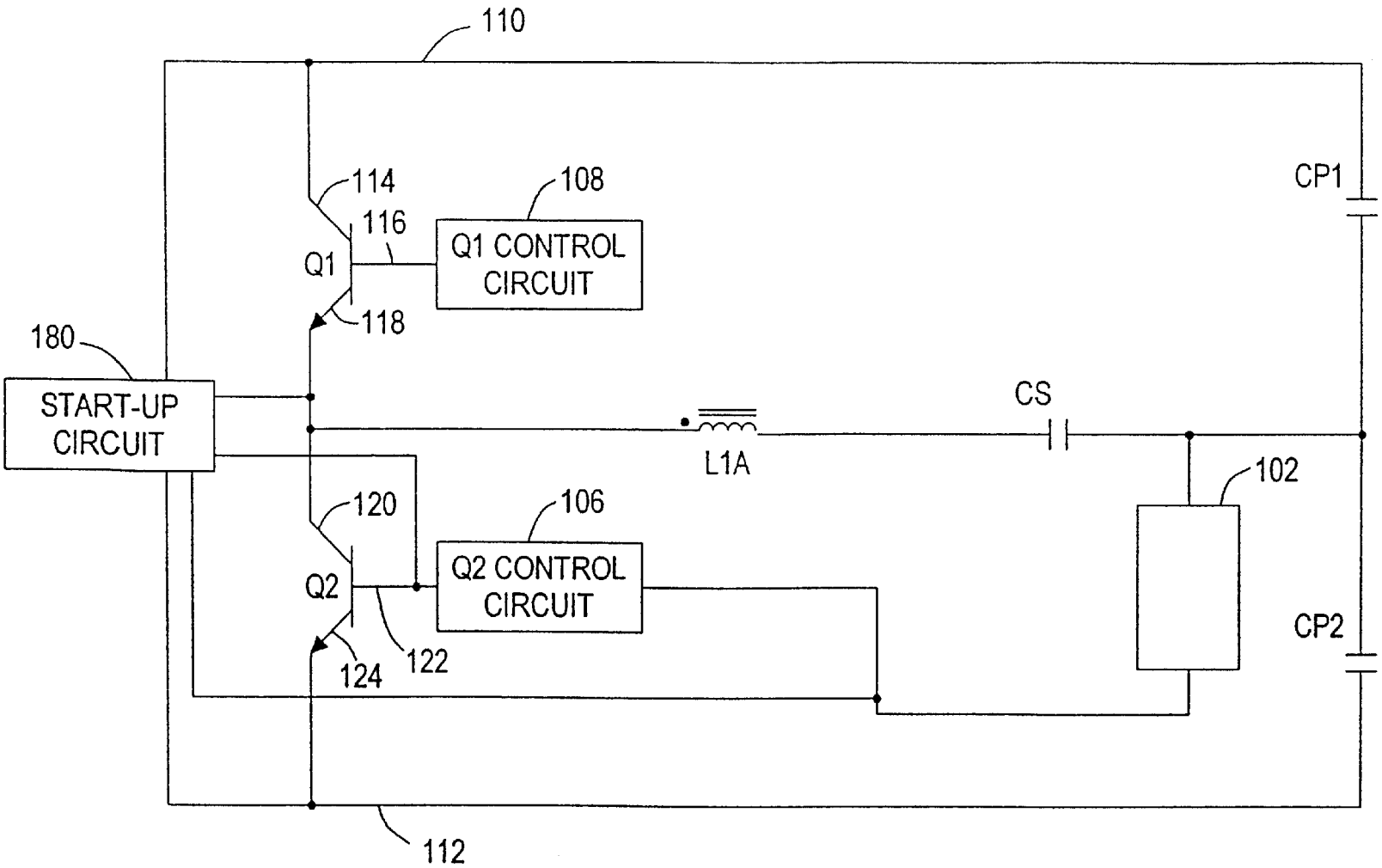
FIG. 7 is a schematic diagram showing further features of the circuit of FIG. 2.
Figure 8:
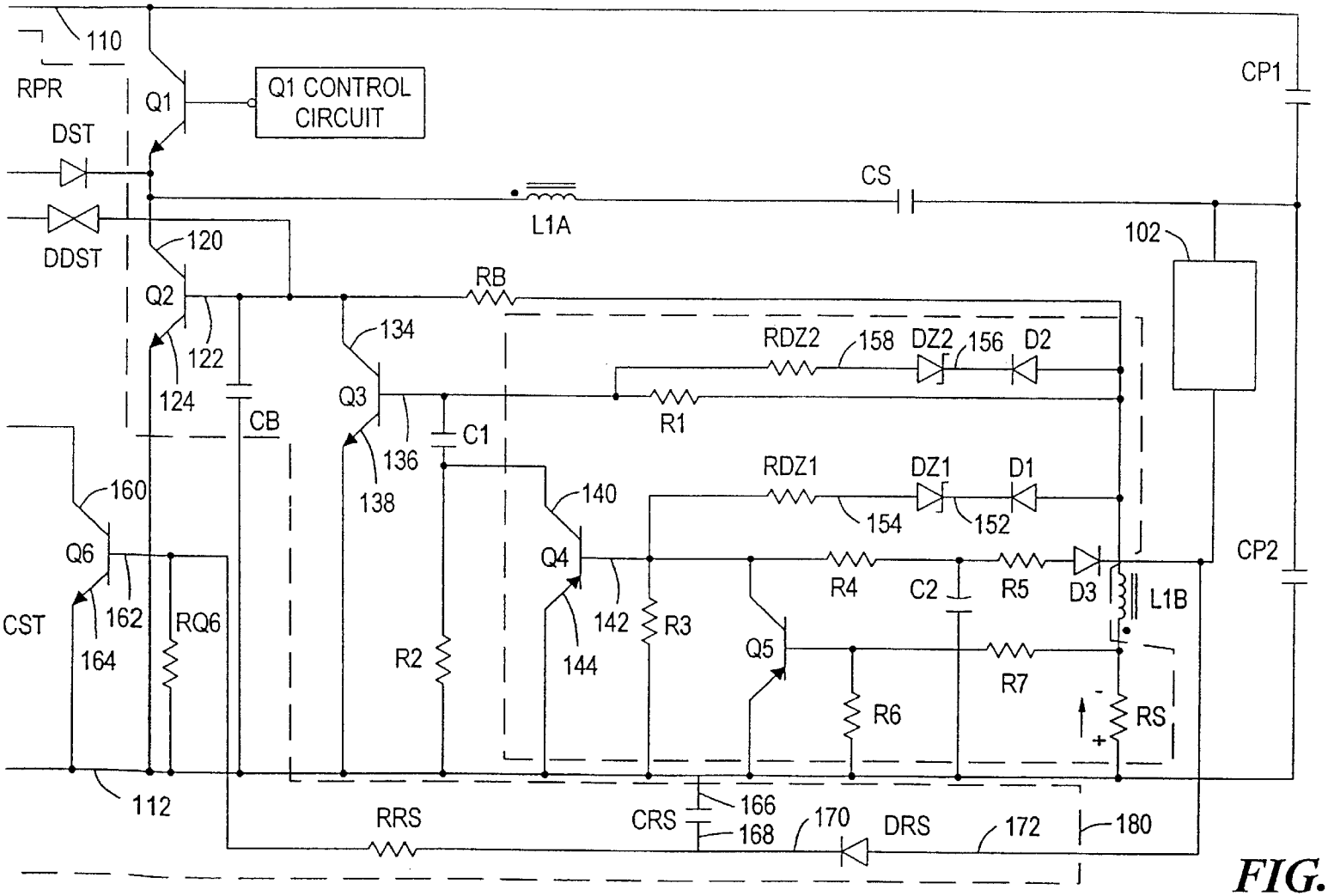
FIG. 8 is a circuit diagram of an exemplary embodiment of the circuit of FIG. 7.

FIGS. 7–8 show an exemplary embodiment of a start-up circuit 180 for implementing a repeating start-up sequence in accordance with the present invention. The start-up circuit 180 is generally coupled between the positive and negative rails 110, 112 of the inverter and to the lamp 102. When the circuit is initially energized, the start-up circuit 180 charges for a period of time and then applies a voltage to the base terminal 122 of the second switching element Q2 to turn it ON and start the circuit.

In one embodiment, the start-up circuit 180 includes a resistor RPR coupled between the positive rail 110 and a start-up capacitor CST which is coupled to the negative rail 112. A start-up diode DST is coupled between the resistor RPR and the collector terminal 120 of the second switching element Q2. A diac DDST is coupled between the resistor RPR and the base terminal 122 of the second switching element Q2. As the circuit is energized, the start-up capacitor CST charges until the diac DDST becomes conductive and positively biases the base terminal 122 of the second transistor Q2 to thereby start the circuit.

In an illustrative embodiment, the start-up circuit 180 further includes a sixth switching element Q6, shown here as a transistor, and a rapid start capacitor CRS for implementing a controlled start-up sequence to periodically apply a strike voltage to a lamp that has failed to light. The transistor Q6 includes a collector terminal 160 coupled to a point between the resistor RPR and the start-up capacitor CST, a base terminal 162 coupled to the rapid start capacitor CRS via a resistor RRS, and an emitter terminal 164 coupled to the negative rail 112. A resistor RQ6 is connected between the base and emitter terminals 162,164 of the transistor Q6. The rapid start capacitor CRS has a first terminal 166 coupled to the negative rail 112 of the inverter and a second terminal 168 coupled to the rapid start resistor RRS and a diode DRS. A cathode 170 of the diode DRS is connected to the capacitor CRS and an anode 172 is coupled to a point between the lamp 102 and the unmarked end of the bias element L1B.

After the circuit starts, the rapid start capacitor CRS becomes charged so that after an end-of-life or other condition has been detected, for example the threshold of the first and/or second zener diode DZ1,DZ2 has been exceeded, the start-up capacitor CST is prevented from charging until the rapid start capacitor CRS discharges. After the capacitor CRS discharges, the transistor Q6 turns OFF and the start-up capacitor CST charges through the resistor RPR until the diac DDST voltage threshold is exceeded and the second switching element Q2 is turned ON. The capacitance value for the rapid start capacitor CRS is selected to attain a predetermined time between detecting an end-of-life condition and repeating a rapid start sequence.

In an exemplary embodiment, a time of about one second is selected for the rapid start capacitor CRS to discharge. For a pre-heat time of about 0.5 seconds and a strike level voltage applied for about 100 milliseconds, the total cycle time is slightly more than 1.5 seconds with a duty cycle of the applied strike voltage less than about 0.001 percent. It is understood, however, that the duty cycle of the applied strike voltage can vary widely depending upon the values of the capacitors CRS,CST. Without limitation thereto, exemplary duty cycles include fifty percent, ten percent, one percent, 0.1 percent, 0.01 percent, 0.001, percent, 0.0001, percent, and 0.00001 percent. Since a strike voltage is applied for a relatively short amount of time as compared to the complete cycle, a higher strike voltage, 1000 volts for example, can be applied to the lamp. Thus, a higher strike voltage, which increases the likelihood of lighting the lamp, can be applied to the lamp while decreasing the overall stress on the circuit components as compared with applying a lower steady state strike voltage, such as 500 volts.

Figure 9:
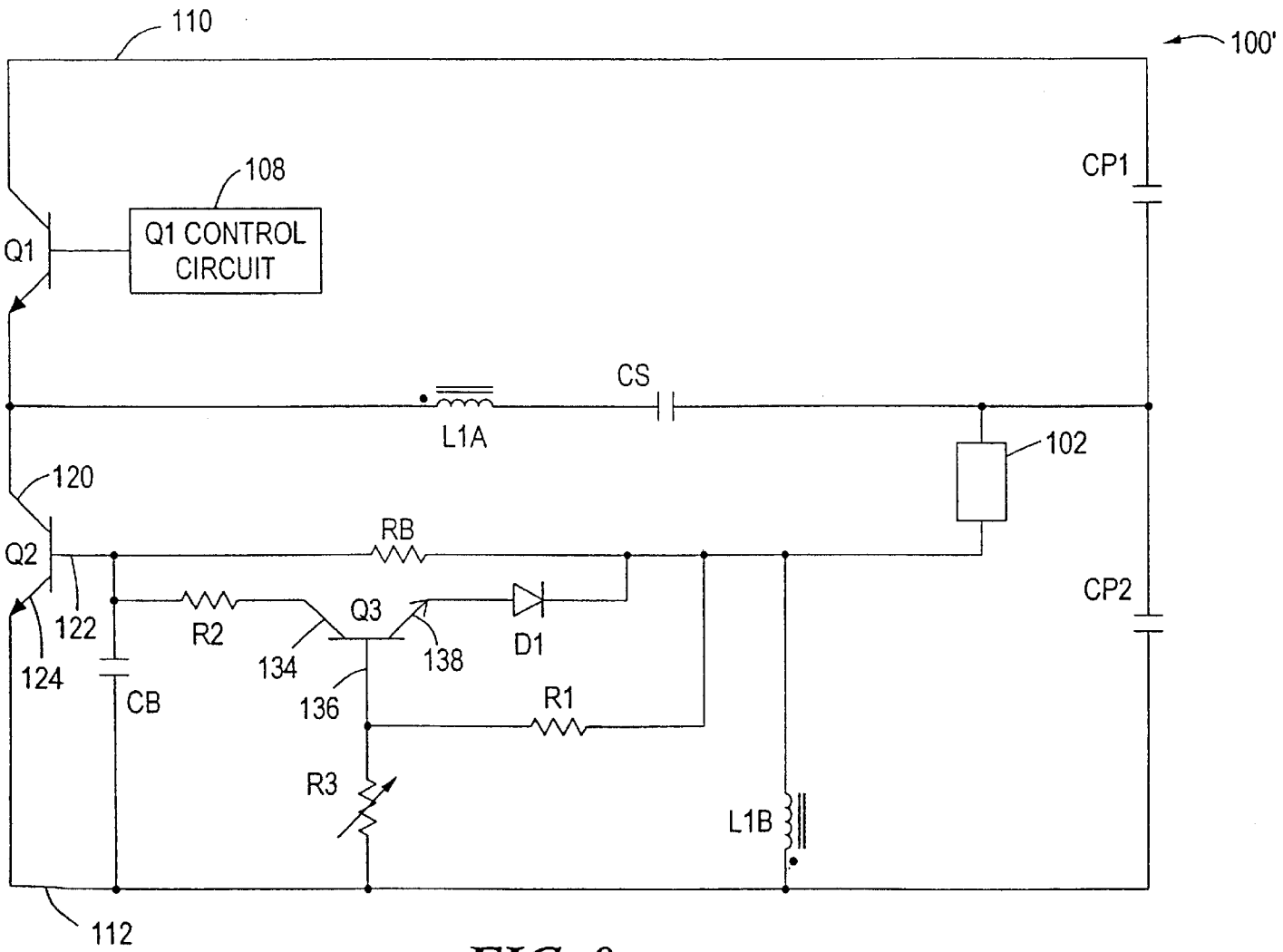
FIG. 9 is a circuit diagram of alternative embodiment of the circuit of FIG. 2.

FIG. 9 shows an alternative embodiment 100' of the inverter circuit 100 of FIG. 2 The inverter circuit 100' includes a third switching element Q3, shown as a transistor, having a collector terminal 134 coupled to the base terminal 122 of the second switching element Q2 via a resistor R2, a base terminal 136 coupled to the negative rail 112 via a potentiometer R3, and an emitter terminal 138 coupled to the unmarked end of the bias element L1B via a diode D1. The base terminal 136 of the third switching element Q3 and the unmarked end of the bias element L1B are connected via a resistor R1.

In operation, the base capacitor CB becomes negatively charged when the second switching element Q2 is OFF which delays the subsequent turning ON of Q2 thereby increasing the dead time and reducing the likelihood of Q1/Q2 cross conduction. More particularly, when the first switching element Q1 is ON and the second switching element Q2 is OFF, the bias element L1B applies a negative potential to the base terminal 122 of the second switching element Q2. The bias element L1B also applies a negative potential to the emitter terminal 138 of the third switching element Q3 which causes Q3 to transition to a conductive state. It is understood that the ratios of the voltage dividing resistors R1,R2 determine at what point the third switching element Q3 turns ON. When Q3 is conductive, a negative charge is stored by the base capacitor CB. Due to the negative charge stored by the base capacitor CB, the turning ON of the second switching element Q2 is delayed when the voltage at the bias element L1B switches to apply a positive bias to the base terminal 122 of the second switching element Q2. The delay in turning ON the second switching element Q2 is effective to prevent or reduce cross conduction of the first and second switching elements Q1,Q2.

Figure 10:
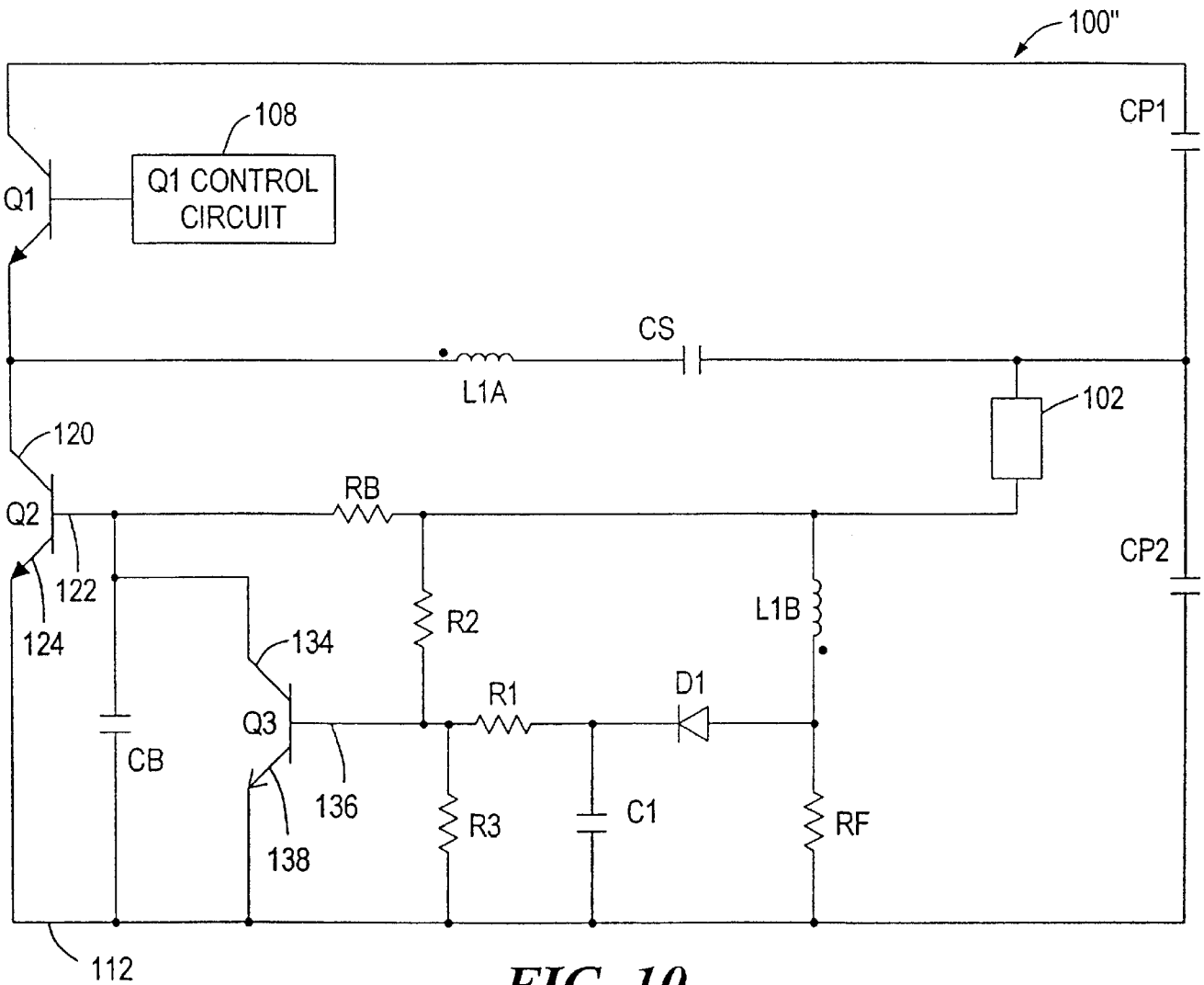
FIG. 10 is a circuit diagram of another alternative embodiment of the circuit of FIG. 2.

FIG. 10 shows another alternative embodiment 100" of the circuit 100 of FIG. 2 for controlling the conduction state of the second switching element Q2. A third switching element Q3, shown as a transistor, has a collector terminal 134 coupled to a base terminal 122 of the second switching element Q2, a base terminal 136 coupled to first, second, and third resistors R1, R2,R3. The second and third resistors R2,R3 form a series circuit path from the unmarked end of the bias element L1B to the negative rail 112 of the inverter. The first resistor R1, a diode D1, and a feedback resistor RF form a series circuit path from the base terminal 136 of Q3 to the negative rail 112. A capacitor C1 has one end coupled to the negative rail 112 and the other end coupled to a point between the first resistor R1 and the first diode D1.

In operation, the second switching element Q2 is turned OFF by the turning ON of the third switching element Q3 to increase the dead time and prevent Q1/Q2 cross conduction. In general, the third switching element Q3 turns the second switching element Q2 OFF when the voltages appearing at the capacitor C1 and across the second resistor R2 combine to bias the third switching element Q3 to a conductive state. More particularly, while the first switching element Q1 is ON (and Q2 is OFF), a voltage across the feedback resistor RF is rectified and the capacitor C1 charges to a predetermined level. When the voltage and currents switch due to the resonant operation of the circuit, the bias element L1B biases the second switching element Q2 to the conductive state. The positive voltage at the unmarked end of the bias element L1B continues to increase, until after a time, the bias element voltage (via R2) combines with the voltage at the capacitor C1 to reach a threshold level at the base terminal of the third switching element Q3 that is sufficient to bias Q3 to a conductive state and thereby turn Q2 OFF. The resulting increase in dead time reduces the likelihood of cross conduction between the first and second switching elements Q1,Q2.

Figure 11:
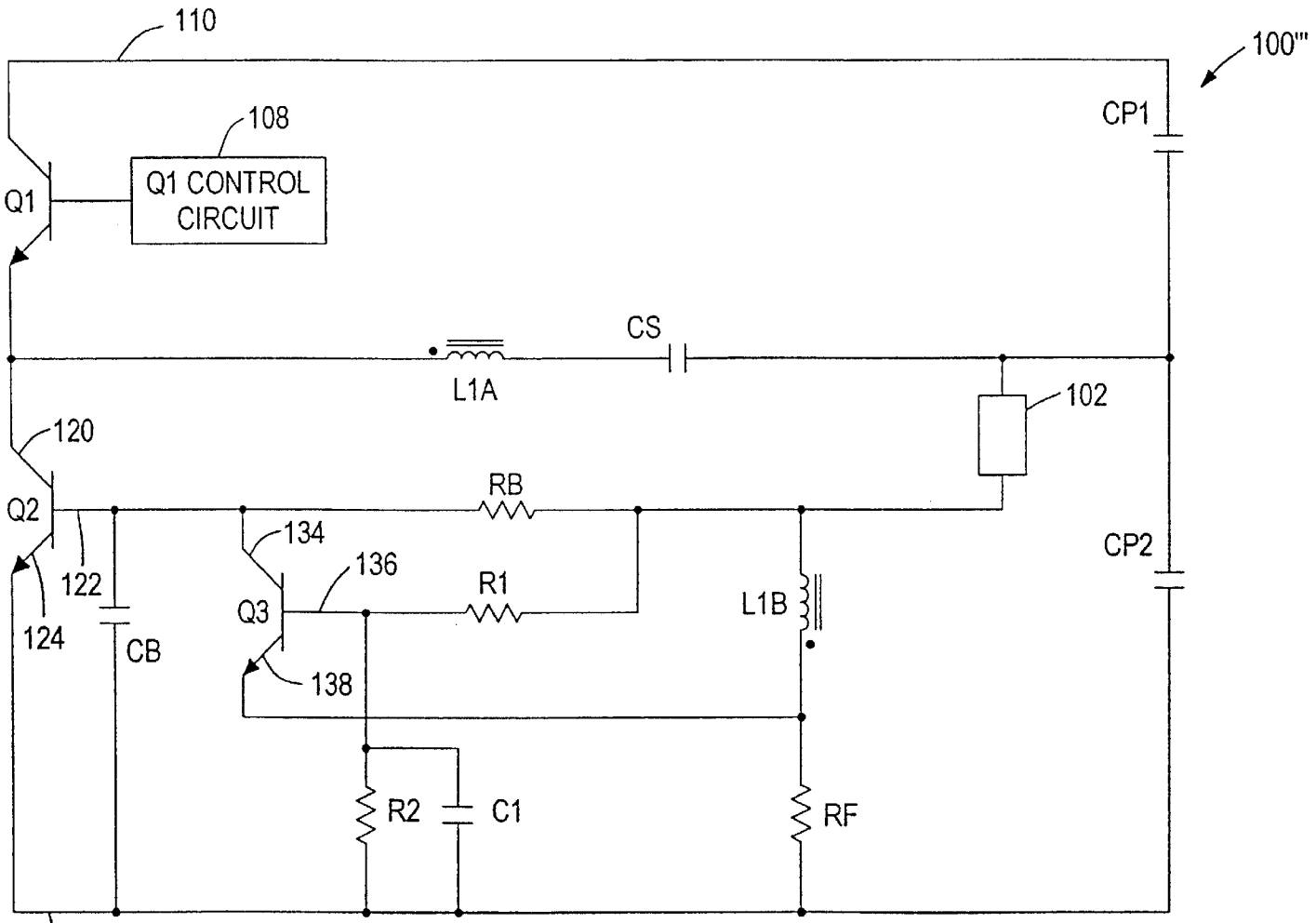
FIG. 11 is a circuit diagram of a further alternative embodiment of the circuit of FIG. 2.

FIG. 11 shows still another alternative embodiment 100'" of the inverter 100 of FIG. 4. The circuit 100'" includes a third switching element Q3 having a collector terminal 134 coupled to the base terminal 122 of the second switching element Q2, a base terminal 136 coupled to the unmarked end of the bias element L1B via a resistor R1, and an emitter terminal 138 coupled to a point between the series-coupled bias element L1B and feedback resistor RF. Resistor R2 and capacitor C1 are coupled in parallel between the base terminal 136 of Q3 and the negative rail 112 of the inverter.

During a transition of Q1 to the ON state, the third switching element Q3 holds Q2 OFF to prevent Q1/Q2 cross conduction. More particularly, current flowing from the negative rail 112 through the feedback resistor RF negatively biases the emitter terminal 138 of the third switching element Q3 to turn or keep Q3 ON. Current flow in this direction is generally associated with the portion of the resonant cycle where the second switching element Q2 is ON. And while the third switching element Q3 is ON, the second switching element Q2 is OFF. Thus, the third switching element Q3 substantially eliminates cross conduction between the first and second switching elements Q1,Q2 as the first switching element Q1 transitions to a conductive state.

Figure 12:
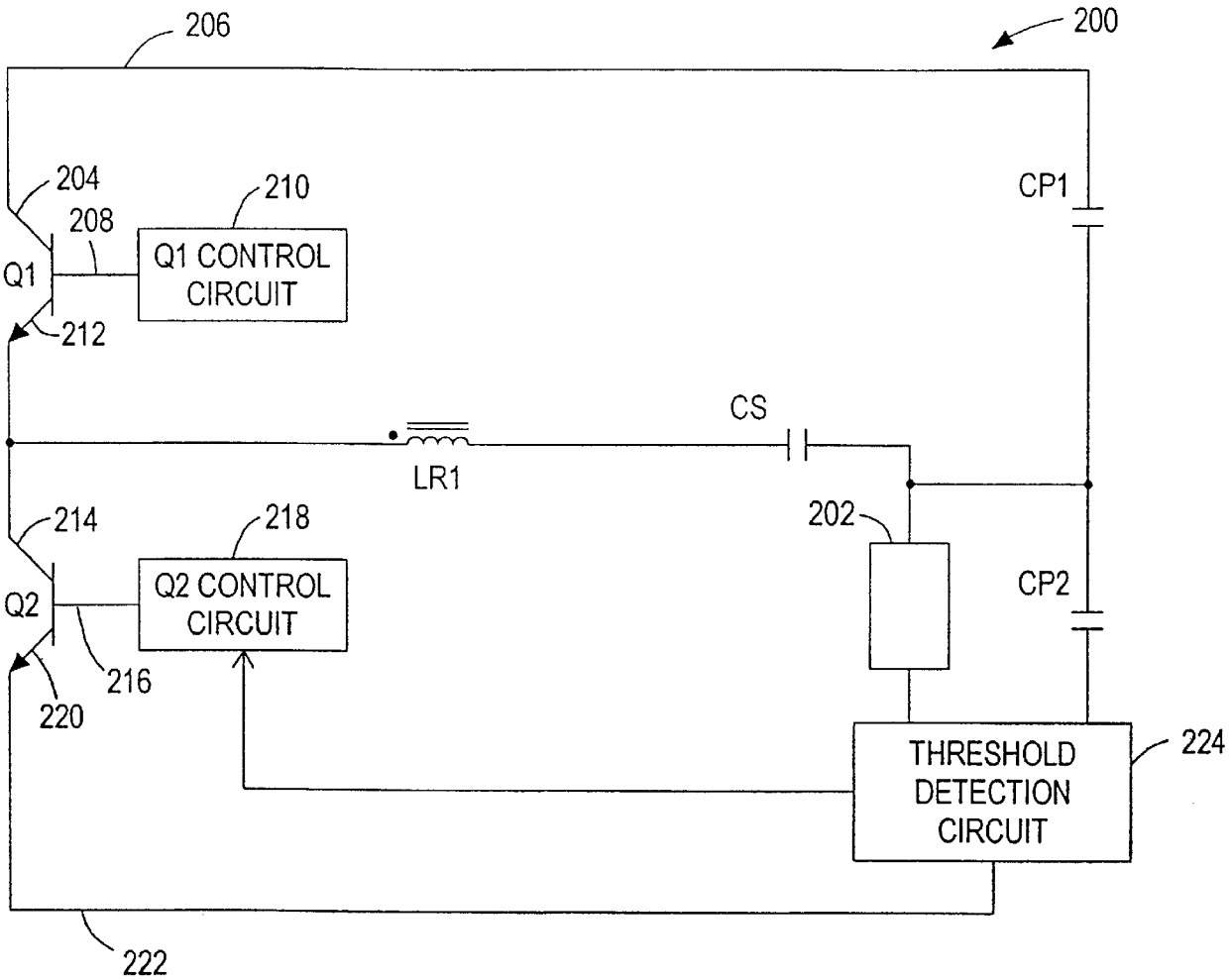
FIG. 12 is a schematic diagram of another embodiment of a circuit in accordance with the present invention.

FIG. 12 shows another inverter circuit 200 in accordance with the present invention that regulates the amount of energy flowing to a lamp 202 by controlling the duty cycle of the second switching element Q2. More particularly, the time during which the second switching element Q2 is conductive is shortened so as to reduce the level of energy to the lamp. It is understood that the duty cycle of the first switching element Q1 can be controlled instead of or in addition to the duty cycle of the second switching element Q2. In an exemplary embodiment, the first and second switching elements Q1,Q2 are coupled in a half bridge configuration. However, it is understood that in other embodiments, full bridge topologies are utilized.

The inverter circuit 200 includes a first switching element Q1, shown here as an npn transistor, having a collector terminal 204 coupled to a positive rail 206 of the inverter circuit, a base terminal 208 coupled to a first control circuit 210, and an emitter terminal 212 coupled to the second switching element Q2. The second switching element Q2 includes a collector terminal 214 coupled to the first switching element Q1, a base terminal 216 coupled to a second control circuit 218 and an emitter terminal 220 coupled to a negative rail 222 of the inverter circuit.

A first resonant inductive element LR1 is coupled in series with a first DC blocking capacitor CS. The lamp 202 is coupled to a point between first and second bridge capacitors CP1,CP2 which are coupled end to end between the positive rail 206 of the inverter and a threshold detection circuit 224. The threshold detection circuit 224 provides an indication to the second control circuit 218 when the energy through the lamp 202 and/or capacitor CP2 exceeds a respective threshold. It is understood that during rapid start mode of operation (when a current flows through the lamp filaments to pre-heat the filaments), the current through the capacitor CP2 is of interest and that during normal operation (when the lamp is conducting current and emitting light), the current through the lamp 202 is of particular interest.

Figure 13:
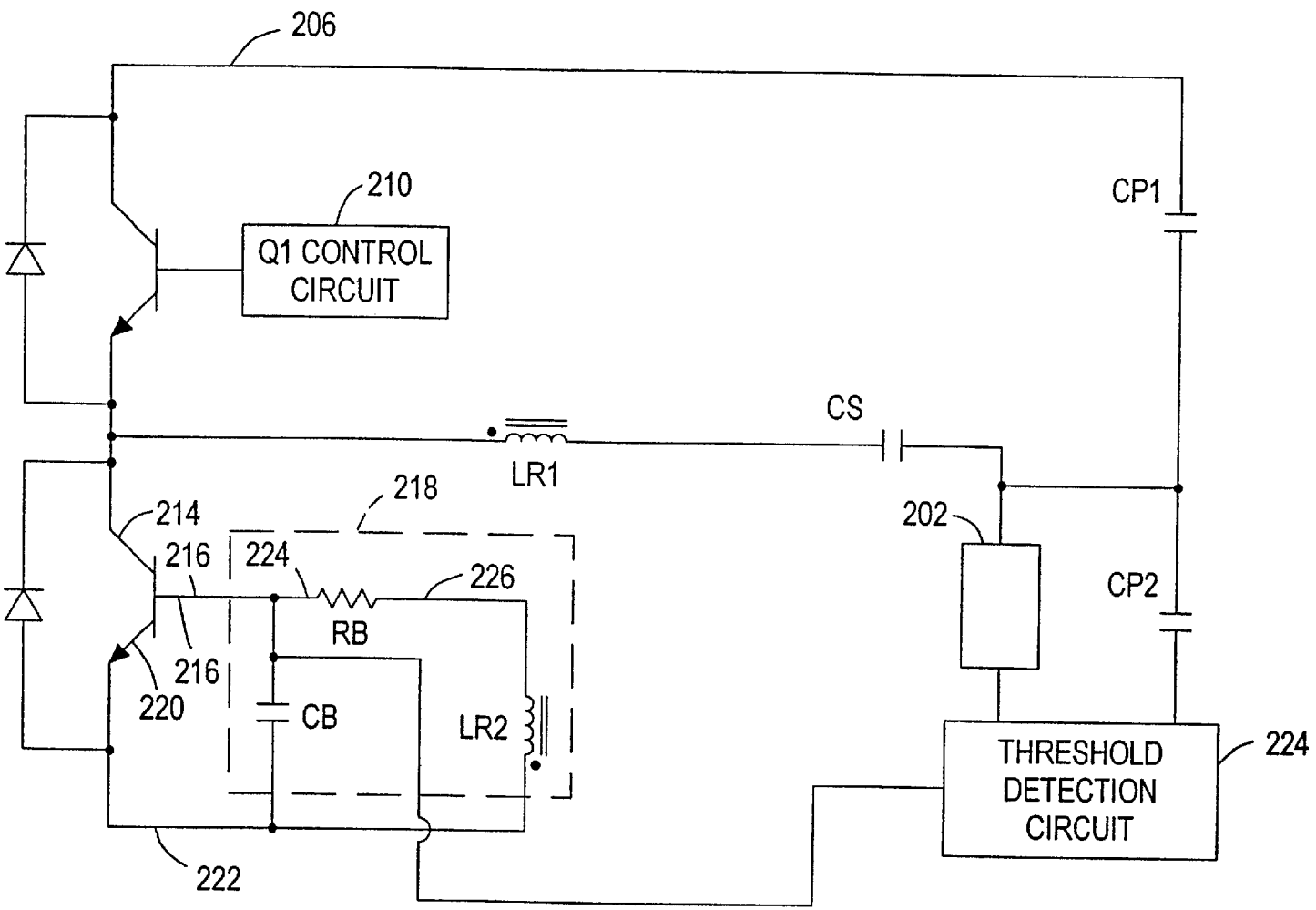
FIG. 13 is a schematic diagram that includes further details of the circuit of FIG. 9.

FIG. 13 shows an exemplary embodiment of the second control circuit 218 of FIG. 12. The second control circuit 218 includes a base capacitor CB coupled between the base terminal 216 and the emitter terminal 220 of the second switching element Q2. The emitter terminal 220 is shown here as also being coupled to the negative rail 222 of the inverter. A base resistor RB has a first terminal 224 coupled to the base terminal 216 of the second switching element Q2 and a second terminal 226 coupled to an inductive bias element LR2. The bias element LR2 is coupled between the base resistor RB and the negative rail 222. The threshold detection circuit 224 is coupled to the base terminal 216 of the second switching element Q2 for controlling the conduction state of the second switching element Q2, as described below.

In operation, the inverter circuit 200 energizes the lamp 202 with an AC signal at a resonant frequency of the circuit. Current through the lamp 202 periodically reverses direction such that during a first half of a resonant cycle, the first switching element Q1 is ON and the second switching element Q2 is off. And when Q1 is on, current flows from the positive rail 206 to the resonant inductive element LR1 and the lamp in a first direction. After a time determined by the resonant frequency of the circuit the current reverses direction. The first switching element Q1 turns OFF and the second switching element Q2 turns ON. Current then flows from the lamp 202 through the resonant inductive element LR1 and the second switching element Q2. Due to the polarity of the bias element LR2 in relation to the polarity of the resonant inductive element LR1, the bias element LR2 positively biases the base terminal 216 of the second switching element Q2 so as to turn it ON.

Figure 14:
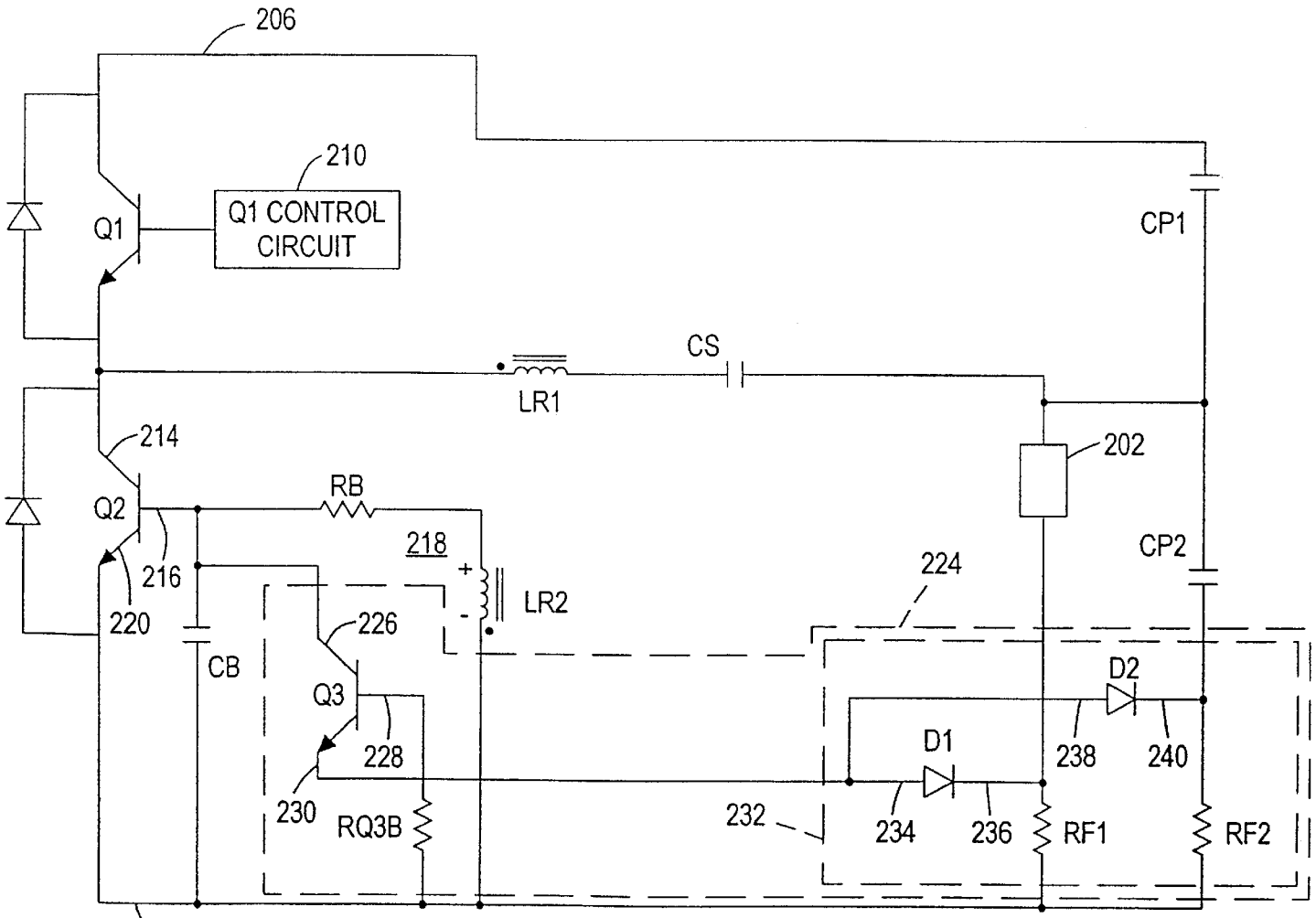
FIG. 14 is a circuit diagram of an exemplary embodiment of the circuit of FIG. 10.

Referring now to FIG. 14, an exemplary embodiment of the threshold detection circuit 224 of FIG. 13 is shown. The threshold detection circuit 224 turns off the second switching element Q2 when the threshold detection circuit detects a current level that is above a predetermined threshold. In the embodiment shown, the threshold detection circuit 224 includes circuitry to separately monitor current through the lamp 202 and current through the capacitor CP2.

The threshold detection circuit 224 includes a third switching element Q3, shown as an npn transistor, having a first or collector terminal 226 coupled to the base terminal 216 of the second switching element Q2, a second or base terminal 228 coupled to the negative rail 222 via a resistor RQ3B and a third or emitter terminal 230 coupled to a feedback circuit 232 formed from a resistor/diode network.

In one embodiment, the feedback circuit 232 includes a first diode D1 having an anode 234 coupled to the emitter terminal 230 of the third switching element Q3 and a cathode 236 coupled to a point between the lamp 202 and a first feedback resistor RF1. The first feedback resistor RF1 is coupled between the lamp 202 and the negative rail 222 for detecting a current flow that is greater than a first predetermined threshold. The feedback circuit 234 further includes a second diode D2 having an anode 238 coupled to the emitter terminal 230 of the third switching element Q3 and a cathode 240 coupled to a point between the bridge capacitor CP2 and a second feedback resistor RF2. The second feedback resistor RF2 is coupled between the bridge capacitor CP2 and the negative rail 222 for detecting a current through the capacitor CP2 that is greater than a second predetermined threshold.

Since the second control circuit 218 and the threshold detection circuit 234 are coupled to the second switching element Q2, the time that the second switching element Q2 is ON is of interest. To reduce the energy at the load when excessive energy levels are detected, the second switching element Q2 is turned off prematurely, i.e., the duty cycle is reduced.

Figure 14A:
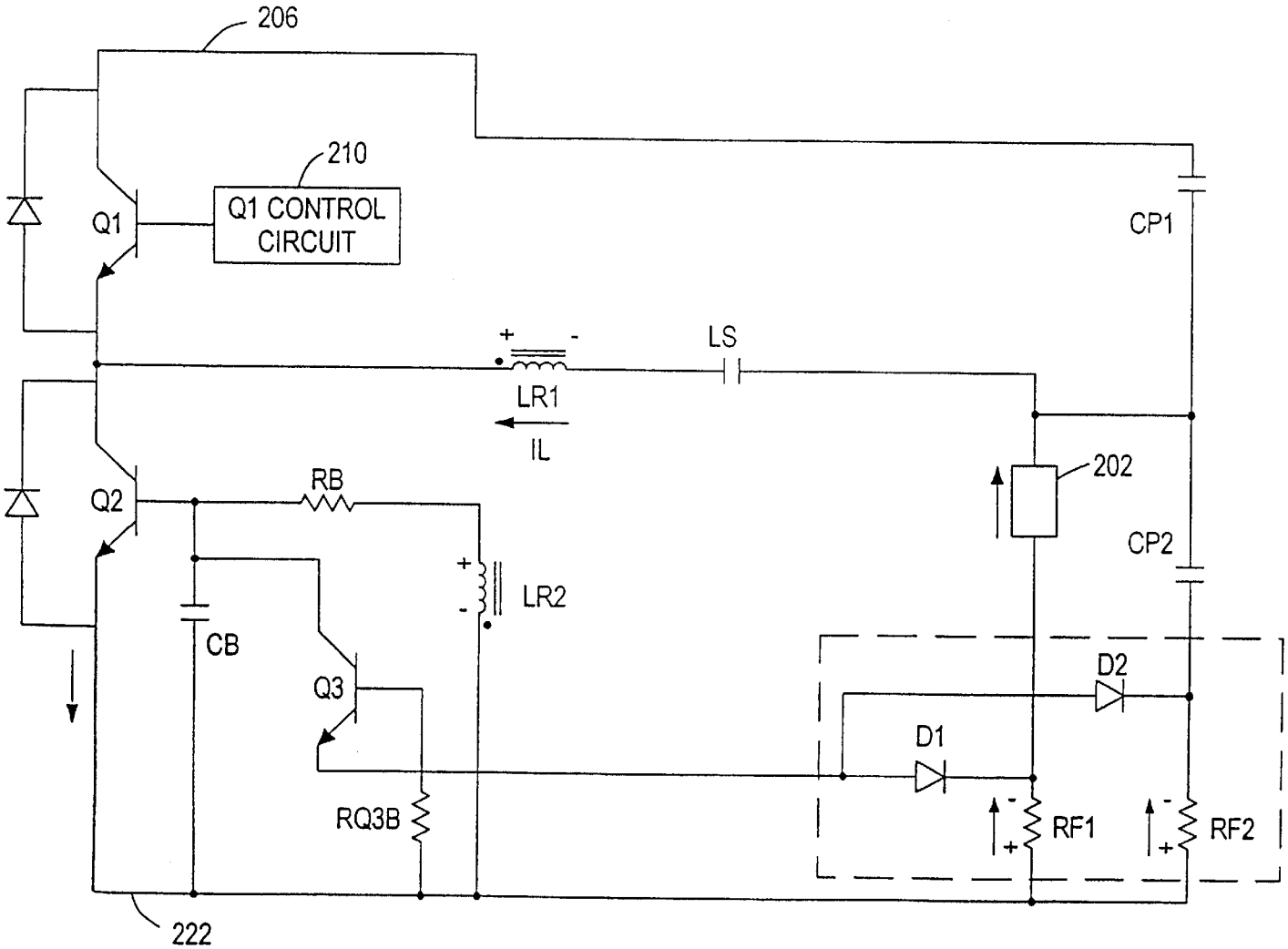
FIG. 14A is circuit diagram that includes further details of the circuit of FIG. 11.

As shown in FIG. 14A, when the second switching element Q2 is ON, a current IL flows in a direction from the load 202 through the resonant inductive element LR1 and the second switching element Q2. Current flowing from the negative rail 222 of the inverter generates a voltage drop across the first feedback resistor RF1. The polarity of the voltage drop across various circuit elements are indicated with a "+" and "−". When the level of current flowing from the negative rail 222 to the lamp 202 is greater than the first predetermined threshold, which is selected based on the impedance value of the circuit elements, e.g., RF1, the third switching element Q3 becomes conductive thereby turning the second switching element Q2 OFF. More particularly, when the voltage drop across the first feedback resistor RF1 is such that the base-emitter junction voltage of Q3 exceeds about 0.7 volts, the third switching element Q3 turns ON thereby turning OFF the second switching element Q2.

The second feedback resistor RF2 is effective to select the second predetermined threshold for a current flowing through the bridge capacitor CP2 during pre-heat or other condition where current may not be flowing through the lamp 202. When the current flowing from the negative rail 222 to the capacitor CP2 generates a voltage drop across the second feedback resistor RF2 that is sufficient to turn the third switching element Q3 ON, the second switching element Q2 is turned OFF. By shortening the ON time of the second switching element Q2, the level of current flowing through the capacitor CP2 is limited to a predetermined level.

Figure 15:
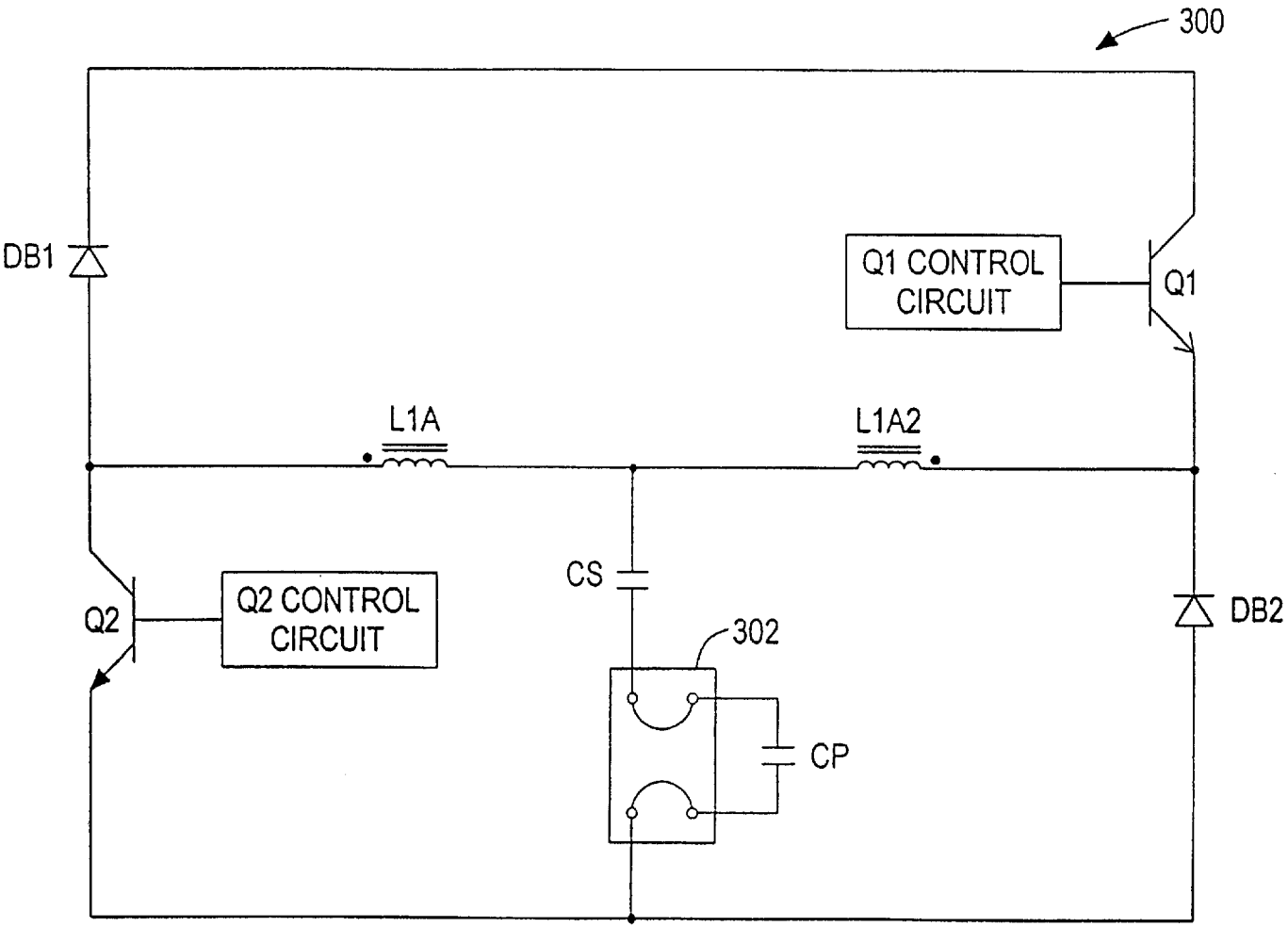
FIG. 15 is schematic diagram of a further embodiment of a circuit in accordance with the present invention.

FIG. 15 shows a further embodiment of an inverter circuit 300 in accordance with the present invention. The inverter circuit 300 has a full bridge topology formed by first and second switching elements Q1,Q2, shown as transistors, first and second bridge diodes DB1,DB2 and inductively coupled first and second inductive elements L1A1,L1A2. During resonant operation of the circuit, the first and second switching elements Q1,Q2 are alternately conductive as current periodically reverses direction. In general, the inverter circuit operates in a repeating sequence of steps as follows: Q2-ON; D1,D2-ON; Q1-ON; and D1,D2-ON. When the first switching element Q1 is ON, current flows through the transistor Q1 and the second inductive element L1A2 to a lamp 302. And when Q2 is ON, the current flows in the opposite direction from the lamp 302 through the first inductive element L1A1 and the second transistor Q2. The first and second diodes D1,D2 are conductive when the first and second switching elements Q1,Q2 are both off, known as dead time, to provide a dissipation path for energy stored in the circuit elements. Operation of a full bridge circuit of this type is described in detail in co-pending and commonly assigned U.S. patent application Ser. No. 08/948,690 incorporated herein by reference above.

Figure 16:
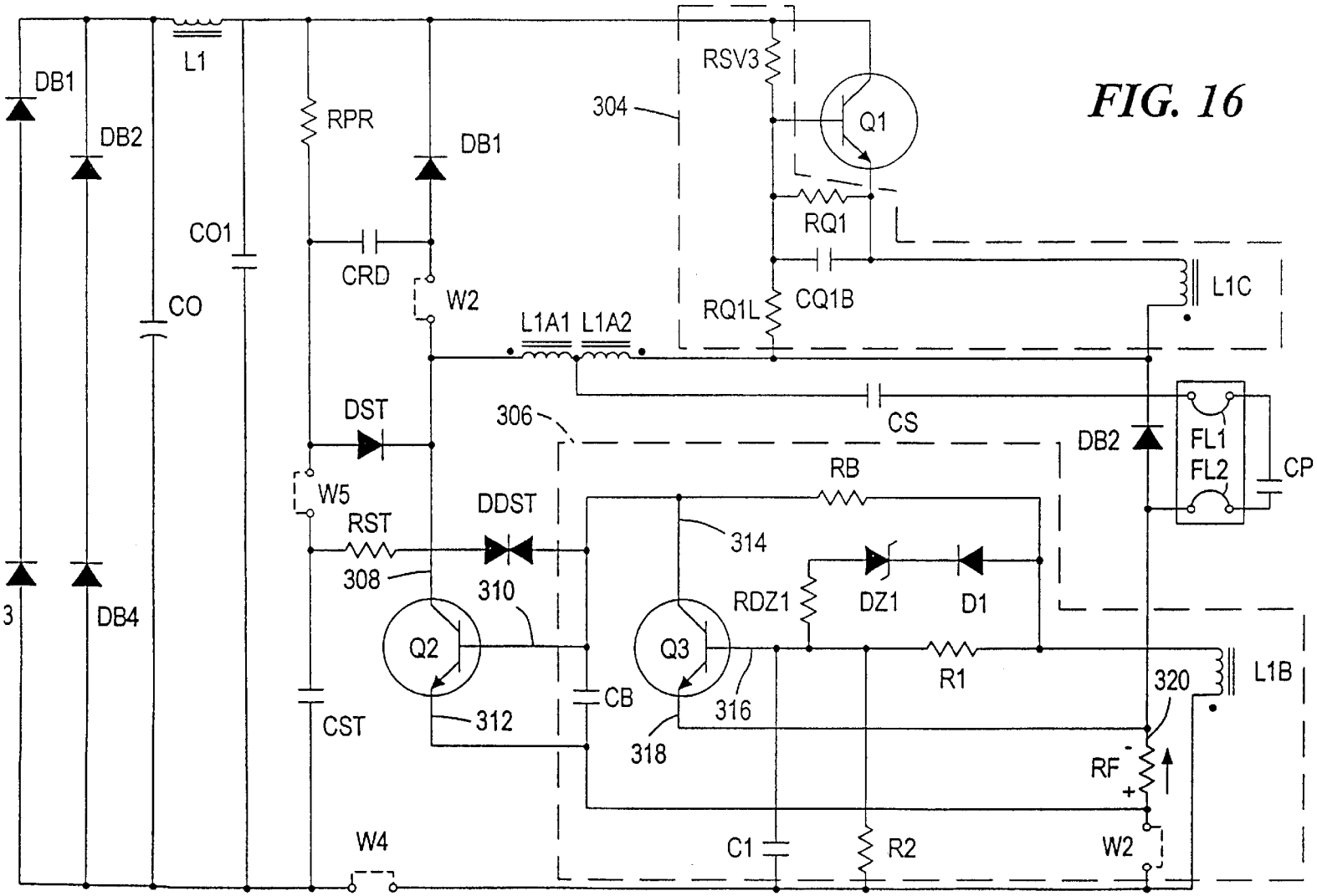
FIG. 16 is a circuit diagram of an exemplary embodiment of the circuit of FIG. 12.

FIG. 16 shows an illustrative embodiment of the inverter circuit 300 of FIG. 15 implementing power control features in accordance with the present invention. The circuit 300, as shown, includes a conventional rectifier circuit formed from bridge diodes DB1-4 and a filter circuit formed from inductor L1 and capacitor C0. Operation of the rectifier and filter circuits are well known to one of ordinary skill in the art. Suffice it here to say that these circuits receive an AC signal and output a DC signal that energizes the inverter circuit via the positive and negative rails. The circuit also includes a start-up circuit formed from resistors RPR, RST, capacitors CST, CRD and diodes DST, DDST. In general, when the start-up capacitor CST charges to a voltage level that is greater then a threshold voltage level of the diac DDST, the second switching element Q2 turns ON thereby starting the circuit.

An exemplary embodiment of a first control circuit 304 for controlling the conduction state of the first switching element Q1 includes an RC network, as shown, formed from RSU3, RQ1, CQ1B, RQ1L and a Q1 bias element L1C which is inductively coupled with the first and second inductive elements L1A1,L1A2. Operation of the Q1 control circuit is similar to that described above. More particularly, the Q1 bias element L1C biases the first switching element Q1 to a conduction state depending upon the voltage polarity of the Q1 bias element L1C. Thus, current flow in a direction from the second inductive element L1A2 to the lamp 302 biases the first switching element Q1 to the ON state and current flow in the opposite direction biases it to the OFF state.

In the illustrative embodiment shown, a second control circuit 306 includes a third switching element Q3, shown as an npn transistor, for controlling the conduction state of the second switching element Q2. The second switching element Q2 has a collector terminal 308 coupled to the first inductive element L1A1, a base terminal 310 coupled to the unmarked end of the bias element L1B via a base resistor RB, and a emitter terminal 312 coupled to the base terminal 310 via a capacitor CB. The transistor Q3 includes a collector terminal 314 coupled to the base terminal 310 of the second transistor Q2, a base terminal 316 coupled to an unmarked end of a bias element L1B via a resistor R1, and an emitter terminal 318 coupled to a first terminal 320 of a feedback resistor RF. A first zener diode DZ1 is coupled in series with a diode D1 and a resistor RDZ1 to form a connection between the base terminal 316 of the third transistor Q3 and the unmarked end of the bias element L1B. The circuit is shown with optimal jumper connections W1-5 that increase circuit flexibility, as known to one skilled in the art.

The third transistor Q3 is controlled at the base and emitter terminals 316, 318. More particularly, the voltage at the bias element L1B appears at the base terminal 316 of the third transistor Q3 and the voltage drop across the feedback resistor RF appears at the emitter terminal 318. In general, the third transistor Q3 controls the duty cycle of the second switching element Q2 in a manner like that described above. More particularly, the bias element L1B turns the second switching element Q2 ON and, after a period of time determined by delay provided with R1,C1, R2, the third transistor Q3 turns ON thereby turning the second switching element Q2 OFF. The configuration of the feedback resistor RF and the first and second switching elements Q2,Q3 regulates the lamp current to a predetermined level such that lamps having differing voltage drops can be energized by the circuit. And the zener diode DZ1 provides a voltage threshold above which the third switching element Q3 turns ON thereby turning the second switching element OFF and reducing the power to the lamp.

One skilled in the art will appreciate further features and advantages of the invention based on the above-described embodiments. Accordingly, the invention is not to be limited by what has been particularly shown and described, except as indicated by the appended claims. All publications and references cited herein are expressly incorporated herein by reference in their entirety.

What is claimed is:

1. A ballast circuit for energizing a lamp, comprising:

an inverter circuit for providing an AC signal to the lamp, the inverter including positive and negative voltage rails, and a first switching element; and a start up circuit including a start up capacitor coupled between the positive and negative voltage rails of the inverter and to the first switching element for charging to a voltage level sufficient to bias the first switching element to a conductive state which initiates operation of the inverter; and a start up switching element coupled to the start up capacitor, the start up switching element having a first state which discharges the start up capacitor and a second state which allows the start up capacitor to store charge.

2. The ballast circuit according to claim 1, wherein the start up circuit further includes a rapid start capacitor coupled to the inverter and to the start up switching element for biasing the start up switching element to the first and second states.

3. The ballast circuit according to claim 2, wherein the rapid start capacitor is coupled to the negative rail of the inverter.

4. The ballast circuit according to claim 2, wherein the start up circuit further includes a diode coupled to the inverter and to the start up capacitor for rectifying a signal which corresponds to the AC signal to the lamp for charging the start up capacitor.

5. The ballast circuit according to claim 4, wherein the diode is coupled to the lamp.

6. The ballast circuit according to claim 1, wherein the start up switching element is a transistor having a first terminal coupled to a first terminal of the start up capacitor, a second terminal coupled to the rapid start capacitor and a third terminal coupled to a second terminal of the start up capacitor.

7. The ballast circuit according to claim 1, further including an end of life circuit for disabling the inverter when a voltage applied to the lamp exceeds a predetermined threshold.

8. The ballast circuit according to claim 7, wherein the rapid start capacitor requires a predetermined amount of time to discharge after which the start up capacitor can store charge.

9. The ballast circuit according to claim 8, wherein the voltage level on the rapid start capacitor biases the start up switching element to a respective one of the first and second states.

10. The ballast circuit according to claim 7, wherein the ballast generates a repeating start up sequence of applying a strike voltage to the lamp at a predetermined duty cycle until the lamp lights.

11. The ballast circuit according to claim 10, wherein the duty cycle of the strike voltage applied to the lamp is less than about ten percent.

12. The ballast circuit according to claim 10, wherein the duty cycle of the strike voltage applied to the lamp is less than about one percent.

13. A ballast circuit for energizing a lamp, comprising:

an inverter circuit having first and second switching elements coupled between positive and negative rails of the inverter;

a start up capacitor having a first terminal coupled to the positive rail and a second terminal coupled to the negative rail;

a start up switching element having a first terminal coupled to the first terminal of the start up capacitor, a second terminal, and a third terminal coupled to the negative rail of the inverter;

a rapid start capacitor having a first terminal coupled to the negative rail and a second terminal coupled to the second terminal of the start up switching element; and a diode coupled between the lamp and the rapid start capacitor.

14. The ballast circuit according to claim 13, further including an end of life circuit which disables the inverter when a voltage applied to the lamp becomes greater than a predetermined threshold.

15. The ballast circuit according to claim 13, wherein rapid start capacitor discharges for a time greater than about 0.1 seconds before the start up switching element transitions to a non-conductive state.

16. The ballast circuit according to claim 14, wherein the ballast generates a repeating start up sequence until the lamp lights.

17. A method for lighting a lamp, comprising:

(a) energizing a ballast circuit having a switching element and a start-up capacitor connected to said lamp, (b) controlling a duty cycle of said switching element to increase energy delivered to said lamp, thereby increasing a voltage applied to said lamp, (c) disabling said switching element if the voltage applied to the lamp increases above a predetermined level;

(d) waiting for a predetermined amount of time; and (e) repeating steps (b)–(d) until the lamp begins to emit light.

18. A method for lighting a lamp, comprising:

(a) energizing a ballast circuit having a switching element and a start up capacitor for initiating operation of an inverter;

(b) applying a steadily increasing strike voltage to the lamp;

(c) disabling the inverter when the voltage applied to the lamp increases above a predetermined level;

(d) waiting for a predetermined amount of time; and (e) repeating steps (b)–(d), wherein the waiting for a predetermined amount of time corresponds to a time required for a rapid start capacitor to discharge which is charged as the inverter operates.

19. A method for lighting a lamp, comprising:

(a) energizing a ballast circuit having a switching element and a start up capacitor for initiating operation of the inverter;

(b) applying a steadily increasing strike voltage to the lamp;

(c) disabling the inverter when the voltage applied to the lamp increases above a predetermined level;

(d) waiting for a predetermined amount of time; and (e) repeating steps (b)–(d), wherein the waiting for the predetermined amount of time further corresponds to a voltage level on the rapid start capacitor which controls a conduction state of a switching element coupled across a start up capacitor for initiating operation of the inverter.

20. The method according to claim 19, wherein the strike voltage has a duty cycle of less than about fifty percent.

* * * * *